US007182027B1

(12) United States Patent
DePietro

(10) Patent No.: US 7,182,027 B1
(45) Date of Patent: Feb. 27, 2007

(54) DEAL DRAWER APPARATUS

(75) Inventor: Mark DePietro, Canton, OH (US)

(73) Assignee: Diebold Incorporated, North Canton, OH (US)

( * ) Notice: Subject to any disclaimer, the term of this patent is extended or adjusted under 35 U.S.C. 154(b) by 1554 days.

(21) Appl. No.: 10/013,012

(22) Filed: Nov. 5, 2001

Related U.S. Application Data

(60) Provisional application No. 60/246,175, filed on Nov. 6, 2000.

(51) Int. Cl.
*E06B 7/32* (2006.01)

(52) U.S. Cl. ..... 109/19; 109/17; 109/66; 232/43.1

(58) Field of Classification Search ..... 109/19, 109/10–13, 17, 66; 232/43.1
See application file for complete search history.

(56) References Cited

U.S. PATENT DOCUMENTS

| | | | | |
|---|---|---|---|---|
| 2,896,748 | A * | 7/1959 | McClintock | 186/37 |
| 3,390,833 | A * | 7/1968 | Harris | 232/43.3 |
| 3,828,698 | A * | 8/1974 | Delamater et al. | 109/19 |
| 4,393,789 | A * | 7/1983 | Glotfelter | 109/19 |
| 4,640,200 | A * | 2/1987 | Richardson | 109/19 |
| 5,615,624 | A * | 4/1997 | Terry et al. | 109/19 |
| 5,799,589 | A * | 9/1998 | Clark | 109/19 |
| 5,802,991 | A * | 9/1998 | Brown et al. | 109/19 |

FOREIGN PATENT DOCUMENTS

| | | | | |
|---|---|---|---|---|
| CA | 788 747 | * | 7/1968 | 109/19 |
| GB | 1 587 410 | * | 4/1981 | 109/19 |

* cited by examiner

*Primary Examiner*—Suzanne Dino Barrett
(74) *Attorney, Agent, or Firm*—Ralph E. Jocke; Daniel D. Wasil; Walker & Jocke

(57) ABSTRACT

A deal drawer apparatus (16) is used in carrying out transactions by transporting items between a service provider and a customer. The deal drawer apparatus includes a movable drawer (92). Movement of the drawer is operative to open and close a door (22). When the drawer is extended, a customer is enabled to access the interior area of the drawer. When the drawer is retracted, a service provider accesses the interior area of the drawer through an opening (40). Access through the opening is controlled by at least one movable panel (42). A panel interlock (158) may enable movement of the panel to an access position responsive to movement of the drawer. A drawer interlock (226) may operate to prevent movement of the drawer when the movable panel is in the access position.

21 Claims, 21 Drawing Sheets

DEAL DRAWER APPARATUS

CROSS REFERENCE TO RELATED APPLICATION

This Application claims benefit under 35 U.S.C. § 119(e) of Provisional Application Ser. No. 60/246,175 filed Nov. 6, 2000.

TECHNICAL FIELD

This invention relates to a deal drawer apparatus. Specifically this invention relates to a deal drawer apparatus that extends through a wall and which enables transactions to be conducted between a customer and a service provider.

BACKGROUND ART

Deal drawers are known in the prior art. Deal drawers can be used in customer service environments to carry out transactions between a transaction service provider and a customer. Deal drawers have been used in drive-through banking applications, gas station applications, payroll window applications, drug store applications and other transaction environments.

Deal drawers are often used in transaction environments where it is desirable to separate the transaction service provider from the customer. This may be desirable for example in situations where the customer is located in an outdoor environment and the service provider is located indoors. The use of the deal drawer enables a customer and the service provider to exchange items such as cash or paperwork while maintaining the separation of the interior environment where the service provider is located, and the exterior environment of the customer. In other transaction environments deal drawers may be used primarily to segregate the service provider and the customers for security reasons. In some cases the customer and the service provider may view each other through a window or other opening that is configured to reduce the risk that the service provider may be threatened by a weapon. The use of the deal drawer enables the service provider and the customer to exchange items while reducing the risk that a person with access to the customer station may threaten the service provider with a weapon.

While deal drawers are useful in a variety of transaction environments, there is still room for improvements that are not obvious to those of ordinary skill in the art. For example it may be desirable to make the overall structure of a deal drawer mechanism more compact. It may also be desirable to provide for relatively greater travel of the drawer mechanism toward the customer so that it is easier for a customer to place items into and remove items from the deal drawer. It may also be desirable to make a deal drawer that is more economical or secure. It may be desirable to provide a deal drawer mechanism that cannot have the drawer moved when a service provider may be accessing the drawer.

It may also be desirable to provide a deal drawer with an automated drive system so that a service provider need not exert manual efforts to open and close a deal drawer. In such an automated deal drawer system it may also be desirable to provide systems that minimize the damage that might occur from the deal drawer bumping into a customer or their vehicle.

Deal drawers can also become broken or damaged. For example if a deal drawer has an automated drive that malfunctions, the service provider may be unable to carry out transactions through the deal drawer until it is fixed. Alternatively customers may inadvertently damage a deal drawer by driving into it or by attempting to improperly place an article within it. In these cases it may be desirable to reduce the period of inoperability and the need for time consuming repairs.

Thus there exists a need for a deal drawer which has one or more improved properties of operation, security, repairability and economy.

DISCLOSURE OF INVENTION

It is an object of the exemplary form of the present invention to provide a deal drawer apparatus.

It is a further object of an exemplary form of the present invention to provide a deal drawer apparatus that has an improved drive system.

It is a further object of an exemplary form of the present invention to provide a deal drawer apparatus that may be moved either mechanically or manually.

It is a further object of an exemplary form of the present invention to provide a deal drawer apparatus with a mechanical drive that provides controlled acceleration and force.

It is a further object of an exemplary form of the present invention to provide a deal drawer apparatus that is relatively compact.

It is a further object of an exemplary form of the present invention to provide a deal drawer apparatus that is relatively easy to install in various environments.

It is a further object of an exemplary form of the present invention to provide a deal drawer apparatus that is relatively easy to repair and replace.

It is a further object of an exemplary form of the present invention to provide a deal drawer apparatus for which the deal drawer mechanism may be readily removed from and installed in a housing.

It is a further object of an exemplary form of the present invention to provide a deal drawer apparatus which reduces the risk of movement of the drawer at times when the drawer is being accessed.

It is a further object of an exemplary form of the present invention to provide a deal drawer apparatus that provides increased security for the service provider.

It is a further object of an exemplary form of the present invention to provide a deal drawer apparatus that is economical to manufacture and operate.

It is a further object of an exemplary form of the present invention to provide a deal drawer apparatus that may be used in numerous types of transaction environments.

It is a further object of an exemplary form of the present invention to provide methods for operation, installation and use of a deal drawer apparatus.

Further objects of exemplary forms of the present invention will be made apparent in the following Best Modes For Carrying Out Invention and the appended claims.

The foregoing objects are accomplished in an exemplary embodiment of the present invention by a deal drawer apparatus. The deal drawer apparatus is mounted through an opening in a wall which divides a customer side from a service provider side. The apparatus includes a housing which extends through the wall. The housing includes a fascia portion accessible from the customer side, which fascia has an opening. A door is movable to open and close the opening.

The housing further includes an inner opening on the service provider side. An assembly is removably mounted in the housing. In the exemplary embodiment the assembly is movably mounted in the housing by moving it generally horizontally through the opening. The exemplary form of the invention further includes a positioning feature which enables the assembly to be readily aligned and releasibly secured in an operative position in the housing.

The assembly further includes a drawer which is movably mounted in supporting connection with the assembly. The assembly may further include a mechanical drive. The mechanical drive is connected to the drawer through a releasible connector. The releasible connector may be relatively readily disconnected from the mechanical drive so that a service provider may move the drawer manually. The drive further includes a force limiting device which is operative to limit the amount of force applied by the drive to move the drawer.

The exemplary embodiment further includes a movable panel in supporting connection with the housing. The panel is positioned in overlying relation of an interior area of the drawer when the drawer is in a retracted position. When the panel is moved to an access position, the service provider is enabled to put items in or take items out of the interior area of the drawer. The panel is in operative connection with an interlock. The interlock holds the panel in a non-access position until the drawer moves to a position so that the interior area underlies the panel. When the drawer is moved to this position, the panel is enabled to open. Thereafter when the service provider closes the panel, the panel remains held in the non-access position by the interlock until the drawer is again moved toward the customer and subsequently retracted.

The exemplary embodiment further includes a latch for holding the fascia door in a locked position when the drawer is retracted within the housing. When the drawer is moved from the retracted position to a position extending outward from the housing, the latch is opened and the door is enabled to be opened. In the exemplary embodiment, the latch is unlatched and the fascia door is moved responsive to movement of the drawer.

In the exemplary embodiment the assembly further includes a control panel which includes at least one actuatable control device. A service provider operates the control device to control the mechanical drive. The control panel closes the inner opening of the housing when the assembly is in the operative position. The exemplary embodiment further includes a controller for controlling the operation of the mechanical drive and the other components of the deal drawer apparatus in response to inputs from the operator.

Alternative exemplary embodiments may include only manual or mechanical drive capabilities. Alternative exemplary embodiments may also include an interlock so as to prevent movement of the drawer when the movable access panel is in the access position in which a service provider is enabled to place items into or remove items from the drawer. Further alternative exemplary embodiments may include an access panel comprised of multiple panel members which extend and retract in a telescoping or folding relation so as to achieve greater access to the drawer while reducing the overall size of the housing. Numerous features and relationships that may be found in other alternative embodiments are described herein.

BEST MODES FOR CARRYING OUT INVENTION

Figure 1:
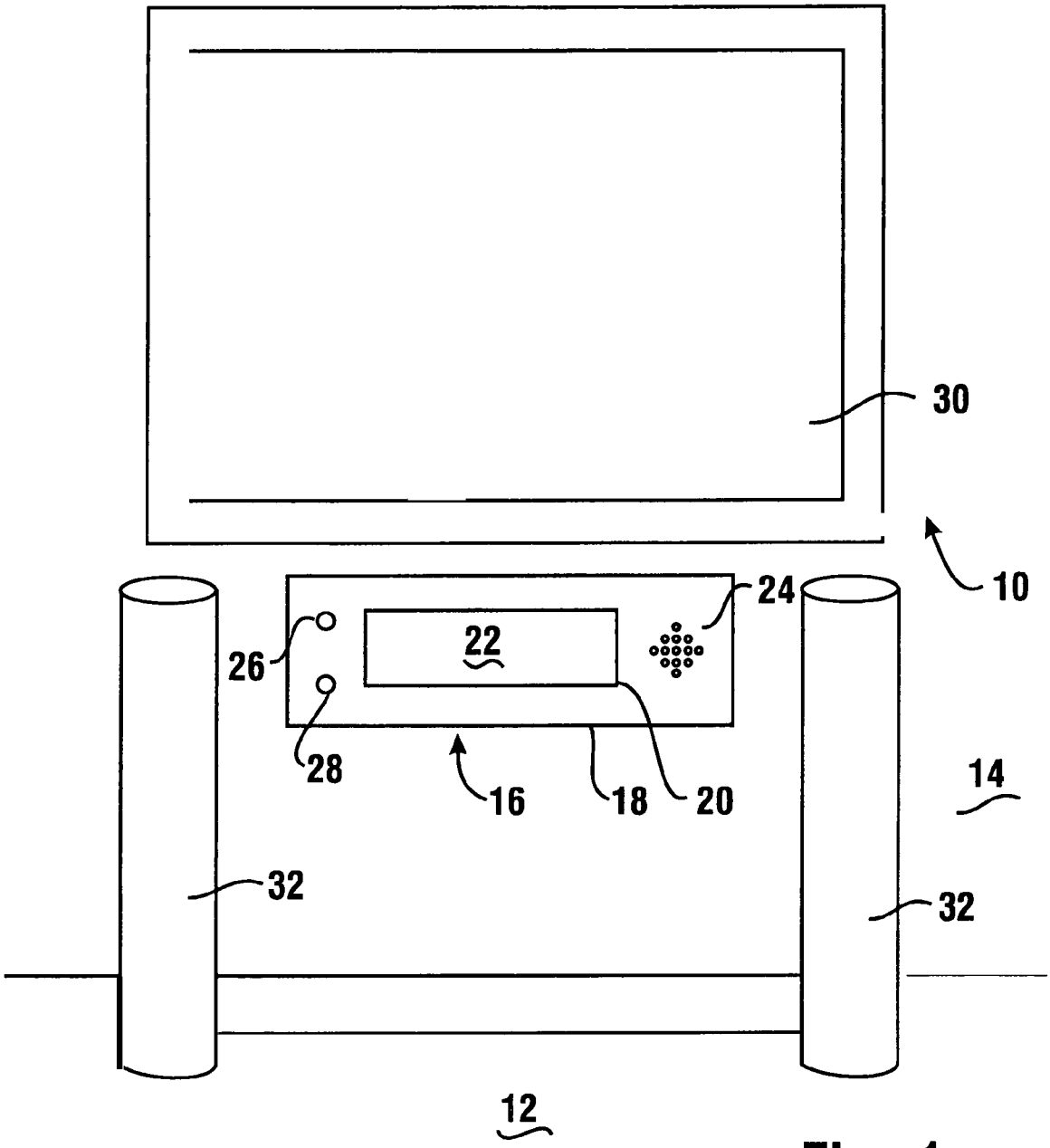
FIG. 1 is a front plan view of an exemplary form of a deal drawer apparatus having features of the present invention installed in a customer service environment.

Referring now to the drawings and particularly FIG. 1 there is shown therein a plan view of a customer service station generally indicated 10. The customer service station is shown from a customer side 12 of a wall 14. In the exemplary embodiment wall 14 is an exterior wall of a building structure. Of course in other embodiments other kinds of walls or dividing structures may be used for bounding a service station.

Service station 10 further includes a deal drawer apparatus 16 of an exemplary embodiment of the present invention. Apparatus 16 includes a fascia 18. Fascia 18 includes an opening 20 therethrough. A door 22 which is shown in the closed position, is movable to open and close the fascia opening 20 in a manner that is later discussed.

The exemplary embodiment of the fascia 18 includes input and output devices. The exemplary output devices in the embodiment shown include a speaker/microphone assembly 24 which includes a speaker for providing audio outputs. Speaker/microphone combination 24 also includes a microphone which enables the customer to provide audible inputs. Another output device in the exemplary embodiment is a status light 26. Status light 26 may be illuminated to provide an indication to a user that the door is open and/or about to open. A further exemplary input device shown in this embodiment is a call button 28. Call button 28 in the exemplary embodiment may be used by a customer to provide a signal to a service provider located on the service provider side of wall 14 to indicate that the customer is at the service station and/or requires attention.

The exemplary form of service station 10 further includes a viewing apparatus 30. In the exemplary embodiment the viewing apparatus 30 comprises a window through which a service provider may view a customer. In alternative embodiments the viewing apparatus may include a camera, periscope or other device through which the service provider can view the customer. In the exemplary embodiment the viewing apparatus 30 also enables the customer to view the service provider. This can be accomplished in other embodiments using a viewing apparatus that includes a display, projection device or other apparatus which presents an image of a service provider to a customer.

The exemplary form of the service station 10 further includes protection posts 32. Protection posts 32 are positioned adjacent to the apparatus 16. Such protection posts may serve in exemplary embodiments to prevent vehicles or other items from striking the apparatus particularly when the drawer thereof is in an extended position as will be later discussed. It should be understood that the exemplary form of the customer station is of the type that may be used in a drive-through banking, parking garage payment, drive-through pharmacy or other transaction environment. These transaction environments are exemplary as is the configuration of the customer station. The exemplary apparatus 16 may be used in a variety of transaction environments. In addition, the apparatus 16 is exemplary and other embodiments of the apparatus may include other, additional or different features within the scope of the present invention.

Figure 2:
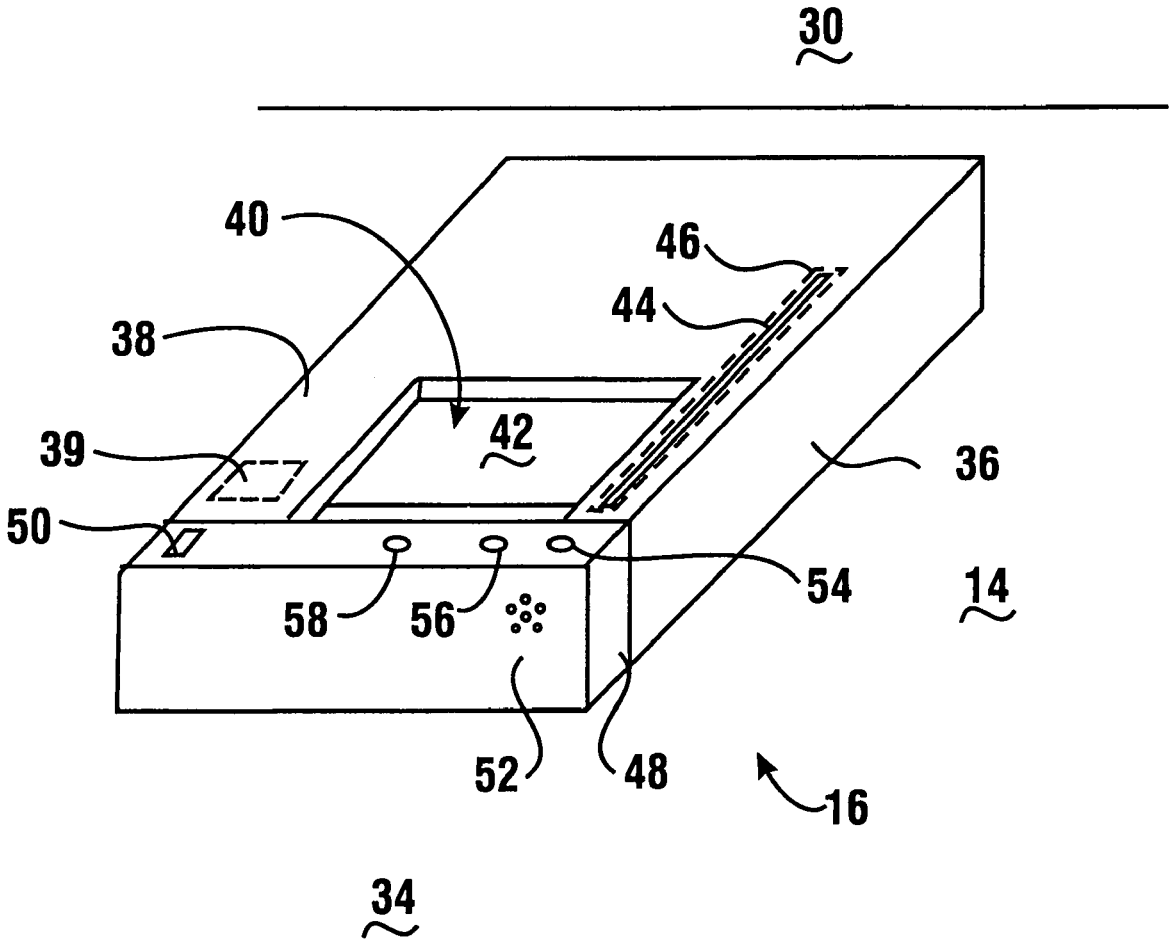
FIG. 2 is an isometric view of the deal drawer apparatus of the exemplary embodiment from the service provider side of the customer service installation.

FIG. 2 shows the deal drawer apparatus 16 from a service provider side 34 of wall 14. As shown in FIG. 2, the deal drawer apparatus includes a housing 36 that extends into the service provider area from the wall 14. The housing includes an upper wall 38. Upper wall 38 has an upper opening 40 therethrough. A panel 42 which is later described in detail is movably mounted in supporting connection with the housing to control access through the upper opening 40. Upper wall 38 further includes a further opening which comprises an elongated slot 44. In the usual operational position of the deal drawer apparatus, the elongated slot is covered with a removable cover 46 which is shown in phantom. The purpose of the elongated slot 44 is later discussed in detail.

The deal drawer apparatus of the exemplary embodiment further includes a control panel 48. The control panel 48 of the exemplary embodiment includes at least one actuatable control device 50. In the exemplary embodiment the actuatable control device comprises a manual switch that a service provider actuates to move a drawer between a first position in which items can be added to or removed from the drawer by the service provider, and a second position from which items can be added to or removed from the drawer by a customer. This will be later discussed in detail.

The control panel of the exemplary embodiment further includes other input and output devices. These may include for example a microphone and speaker combination 52 for communicating with the customer, a control device 54 for controlling operation of audio communications with the customer, an indicator device 56 to indicate a request from a customer through the call button on the fascia. A further exemplary output device is indicator device 58 which in the exemplary embodiment indicates the position of the drawer. It should be understood that these input and output devices are exemplary. In other embodiments such devices may not be used and/or additional devices may be present. In alternative embodiments input and output devices on the service provider side or customer side may be included in locations other than on the deal drawer apparatus. For example the service provider may have a station which includes separate microphones, speakers, indicators, control switches and other appropriate devices for controlling the deal drawer apparatus and/or other items at the service provider station.

Figure 3:
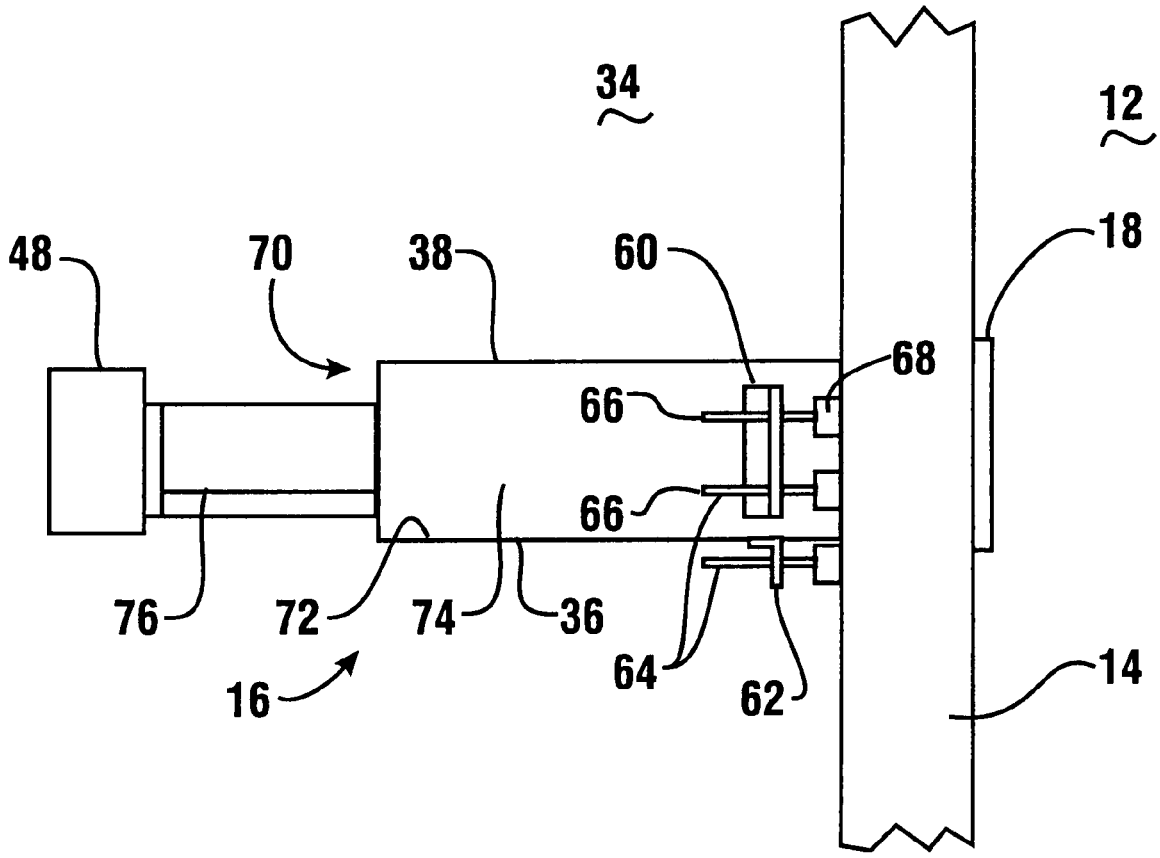
FIG. 3 is a right side view showing the housing of the deal drawer apparatus with the drawer assembly partially retracted.
Figure 4:
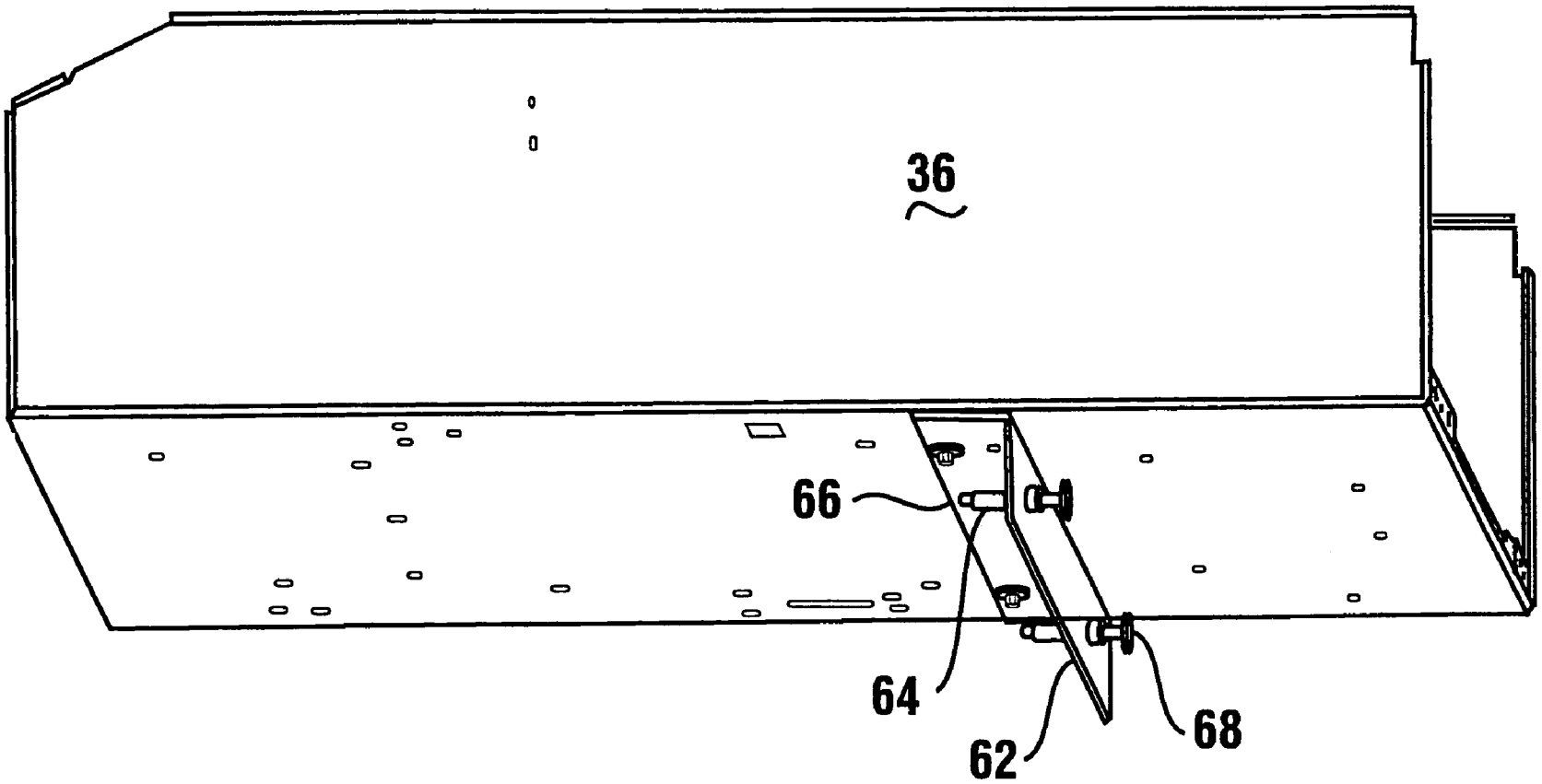
FIG. 4 is a bottom isometric view showing a portion of the housing of the deal drawer apparatus shown in FIG. 3.

As shown in FIG. 3 the exemplary embodiment of the deal drawer apparatus 16 is mounted in supporting connection with wall 14. The housing 36 includes one or more brackets 60, 62 that is in operative connection therewith. Brackets 60 and 62 may be permanently attached to the housing 36 in some embodiments. However in the exemplary embodiment brackets 60 and 62 may be releasibly attached to the housing through fastening devices such as is shown in FIG. 4. It should also be understood that as shown in FIG. 4, some embodiments may only include brackets on one side of the housing. Alternative embodiments may include brackets on several sides of the housing.

As shown in FIGS. 3 and 4 the brackets are in supporting connection with clamp members 64. Clamp members 64 include a back portion 66. Back portion 66 in the exemplary embodiment includes a hex head or other engageable portion which is suitable in the exemplary embodiment for turning the clamp member. In the exemplary embodiment the clamp members are threaded adjacent to the supporting brackets. This enables each clamp member to be selectively moved toward or away from wall 14 by turning the back portions of the respective clamp member. Each clamp member includes an enlarged head portion 68 which is engaged with the wall 14 when the apparatus 16 is mounted. This enables the housing 36 to be mounted in supporting connection with the wall by having the wall held in intermediate clamped relation between the fascia portion 18 and the bracket. Because the fascia portion is held by internal fastening methods to the housing, the mounting of the exemplary embodiment provides a relatively secure yet simple way of securing the housing 36 in connection with the wall.

As represented in FIG. 3 the housing 36 includes an inner opening 70. The inner opening 70 is bounded by the upper wall of the housing 38. The inner opening of housing 36 is also bounded by a lower wall 72 and a pair of spaced side walls 74. The housing walls form a cavity into which a drawer assembly 76 can be removably mounted. In the exemplary embodiment the drawer assembly 76 is installed in the housing by moving the assembly generally horizontally through the inner opening 70. Further as shown in FIG.

3, in the exemplary embodiment the drawer assembly 76 has the control panel 48 in supporting connection therewith. When the drawer assembly is installed in the operative position in the housing, the control panel of the exemplary embodiment generally closes the inner opening 70.

Figure 7:
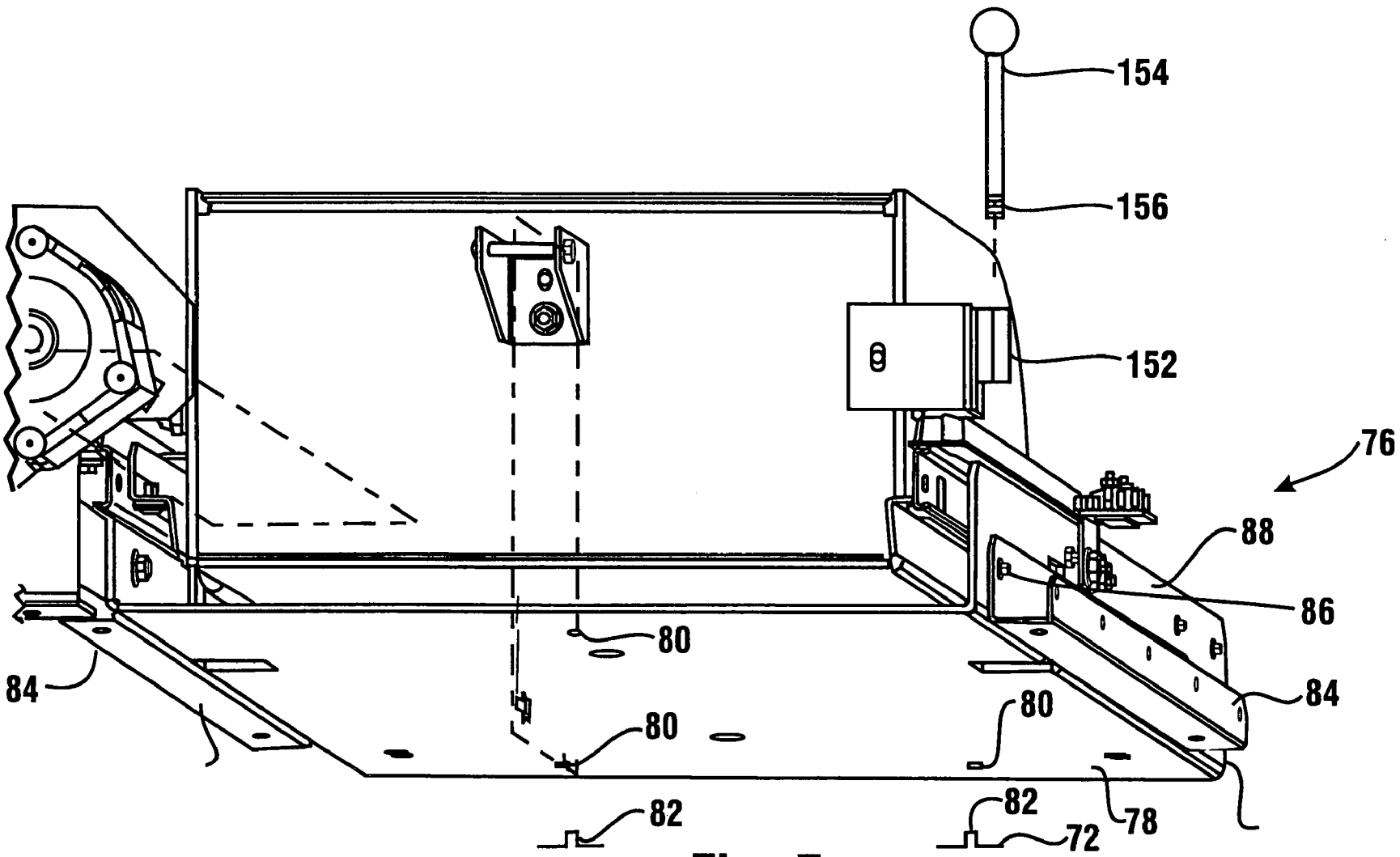
FIG. 7 is a rear isometric view of the assembly with the drawer in a retracted position and schematically representing the installation of a handle with a releasible coupling that can be used for manual movement of the drawer.

As schematically represented in FIG. 7 the exemplary embodiment includes a positioning feature which facilitates positioning the drawer assembly 76 in the operative position within the housing. In the exemplary embodiment the positioning feature includes interengaging projections and recesses between the housing and the drawer assembly. The interengaging projections and recesses operate to releasibly hold the assembly in the operative position on the housing. However when it is desired to remove the drawer assembly the projections and recesses may be relatively readily disengaged so as to enable removal of the assembly therefrom. This facilitates servicing of the exemplary embodiment.

As shown in FIG. 7, the assembly 76 includes a base 78. Base 78 includes a plurality of recesses 80 therein. As schematically represented in FIG. 7, lower wall 72 includes upward extending projections 82, only two of which are shown. In the exemplary embodiment the projections and recesses are positioned so as to engage when the base 78 is moved to a position at which the assembly is enabled to allow the apparatus to properly operate within the housing. As can be appreciated, in the exemplary embodiment the weight of the assembly operates to help hold the housing and the drawer assembly in the proper position.

In the exemplary embodiment a pair of guide rails 84 is provided. The guide rails may be operatively connected to the side walls 74 of the housing and/or to the assembly 76. The guide rails 84 facilitate the alignment of the assembly as it is moved into and out of the inner opening 70 of the housing. As can be appreciated and for example, the guide rails may be generally attached to the side walls of the housing within the interior thereof. As a result when a service person wishes to install or remove the drawer assembly, they may readily do so. Particularly when the drawer assembly is to be reinstalled, the guide rails facilitate moving the assembly to the operative position without requiring the serviceperson to do extensive experimentation as to the proper position for alignment. Once in the proper position the assembly may be held therein through use of fasteners such as for example fasteners 86. In the exemplary embodiment these fasteners are required due to the releasible nature of the positioning feature.

It should be understood that while in the exemplary embodiment described the guide rails are attached to the walls of the housing while the assembly is moved, in alternative embodiments the guide rails may be removed with the assembly. In such embodiments fastening of the assembly within the housing may be done through fasteners or other methods which engage the guide rails to the housing once the assembly is in the operative position. Numerous equivalent approaches may be achieved for providing a positioning feature and guides which achieve removable mounting of a drawer assembly within a housing, and which facilitate the proper installation thereof utilizing the principles of the invention.

Figure 5:
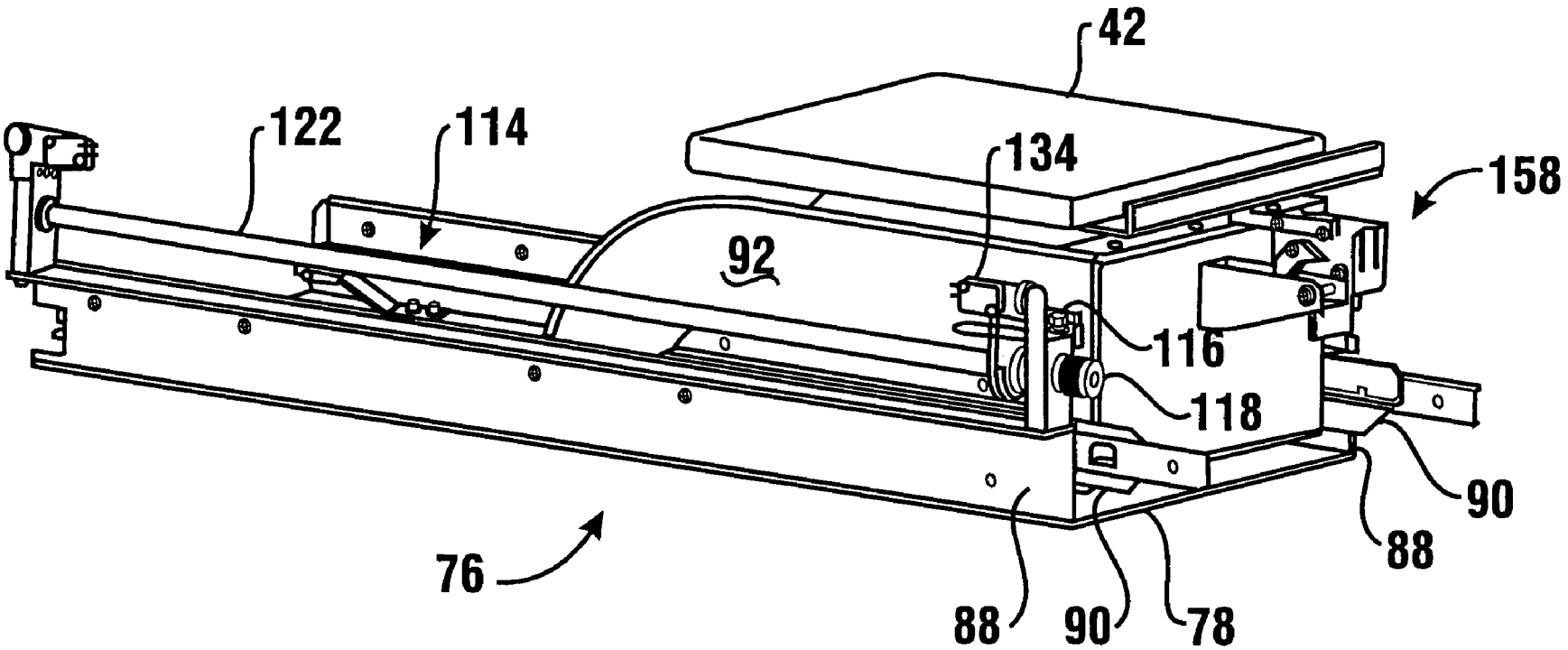
FIG. 5 is a partial isometric view showing the assembly including the drawer and panel in a retracted position.

As shown in FIG. 5, the base 78 is generally unshaped in cross section and includes a pair of disposed upturned walls 88. In supporting connection with the interior sides of the upturned walls 88 are a pair of slides 90. Slides 90 have in supporting connection therewith a drawer 92. Drawer 92 is movable in supporting connection with the slides from a first position shown in FIGS. 5 and 6, to a second position in which the drawer 92 extends outward through the fascia opening 20 as later discussed.

Figure 6:
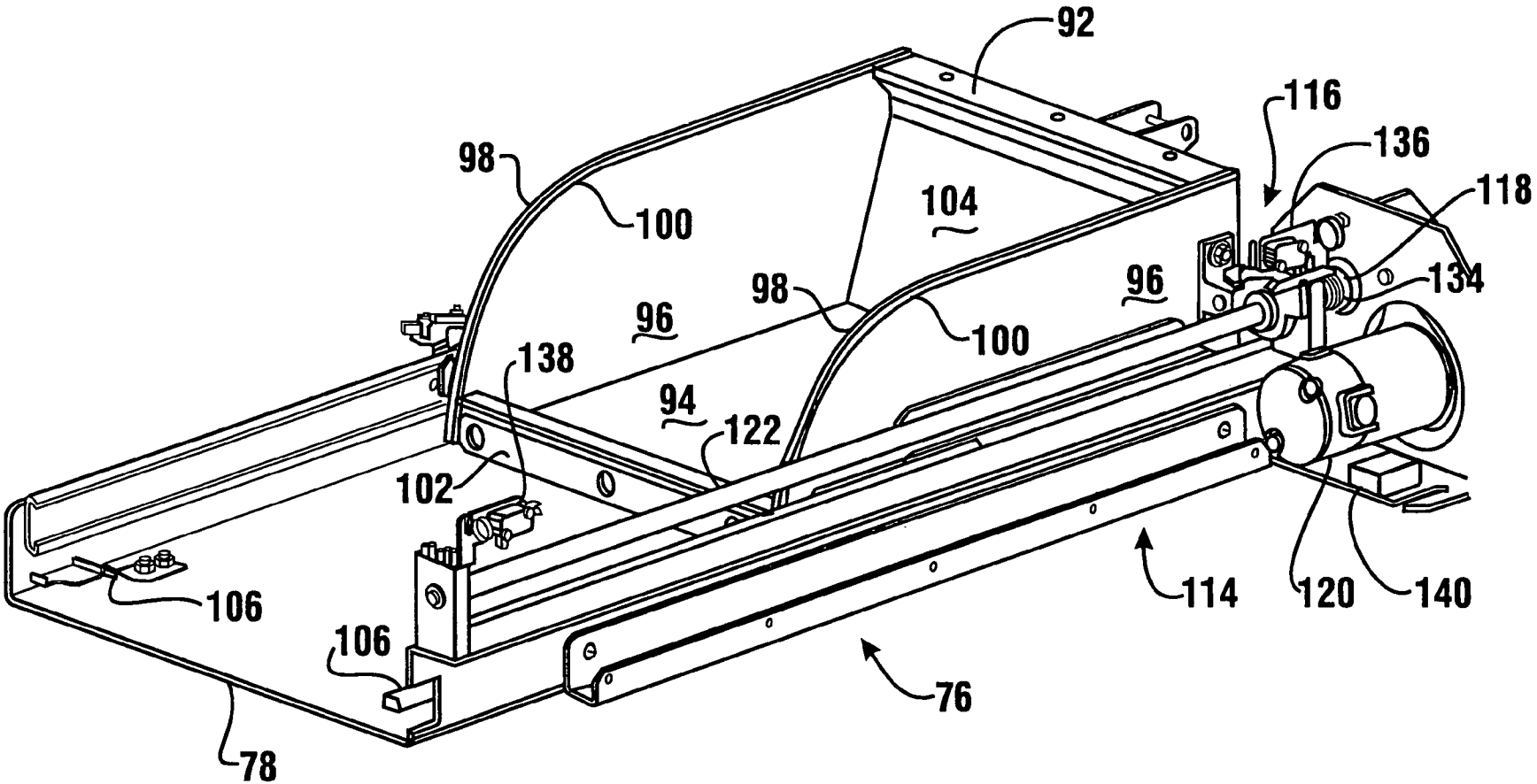
FIG. 6 is an opposite side view similar to FIG. 5 showing the drawer in a retracted position.

Drawer 92 as shown in FIG. 6 includes a floor 94 and a pair of disposed walls 96. Each of walls 96 includes a curved cam surface 98. Cam surface 98 in the exemplary embodiment includes a surface of an elongated grommet generally indicated 100. Grommets 100 in the exemplary embodiment are preferably a relatively hard, low friction material which is suitable for moving the door 22 in operative engagement therewith in a manner as later discussed.

Figure 12:
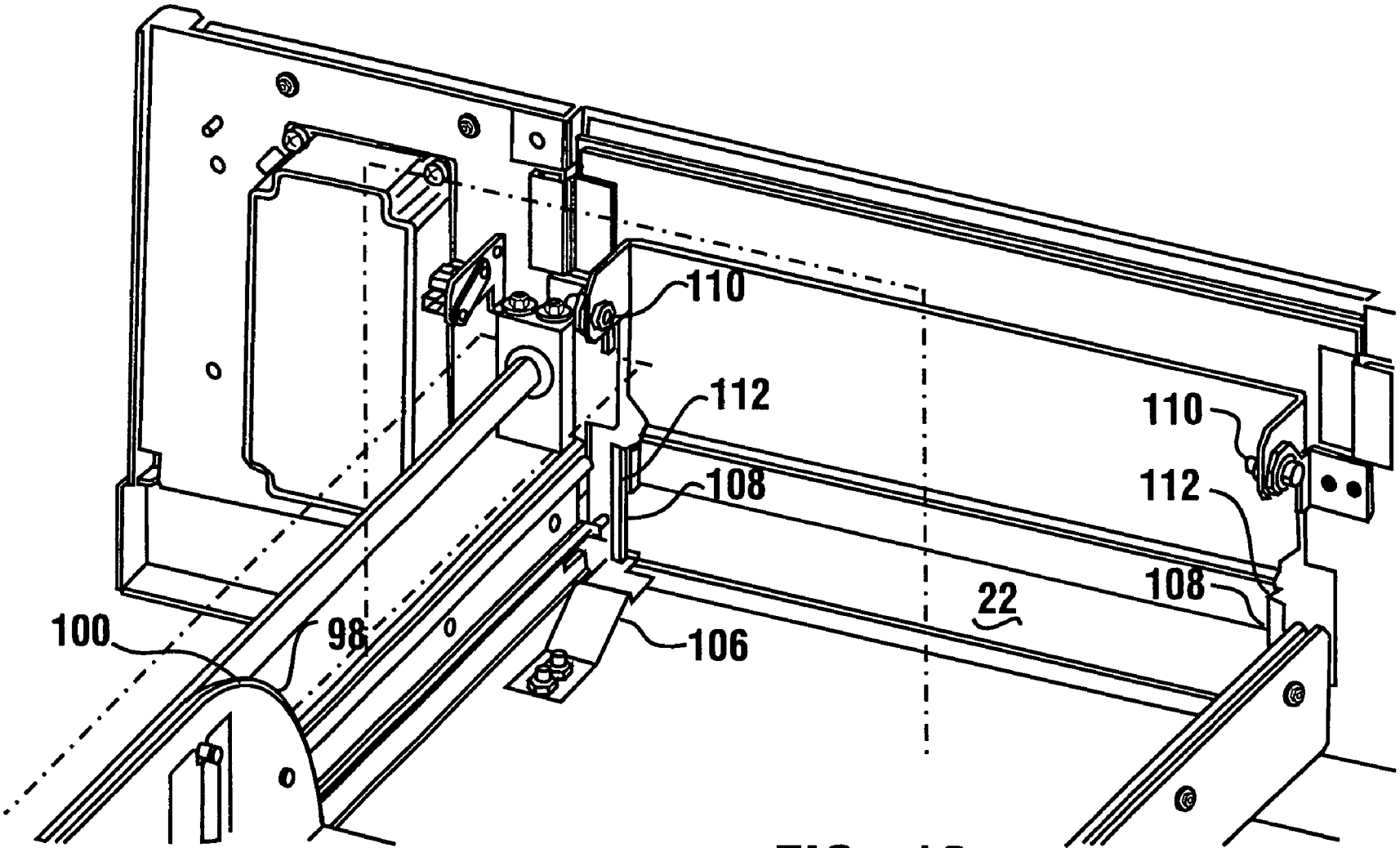
FIG. 12 is an enlarged view similar to FIG. 11 showing the mounting of the fascia door and door latch.

Floor 94 of drawer 92 further includes a front wall 102 and a back wall 104. Base 78 adjacent to the front thereof has attached thereto a pair of transversely disposed deformable movable members 106. In the exemplary embodiment the movable members comprise leaf spring-like material with an upturned finger portion at the end. As best shown in FIG. 12, the movable members engage projections 108 on the door 22 when the door is in a closed position. As a result the action of movable members 106 and projections 108 serve as a latch which holds door 22 in a closed position, closing fascia opening 20.

In the exemplary embodiment door 22 is rotatably movably mounted about a pivot 110. Pivot 110 in the exemplary embodiment is comprised of a pair of ear portions which are rotatable about support brackets. Door 22 as best shown in FIG. 12 further includes guide surfaces 112 which extend inward from the interior surface thereof.

As can be appreciated, in the operative position the assembly 76 is oriented such that the movable members 106 normally engage projections 108 so as to hold door 22 in a closed position. This includes times when the assembly is not in the operative position in the housing as well as when the housing is in the operative position and the drawer is retracted. However, when the drawer 92 moves toward the opening 20 in the fascia, the floor 94 of the drawer through the action of the front wall, deforms movable members 106 downward. This serves to unlatch the latch. This enables the door to move by rotating about the pivot as the floor 92 comes into proximity therewith. As the door moves further toward and through the opening, a guide surface engages the elongated grommets 100 and the cam surfaces 98 thereon. Such engagement causes the cam surfaces to move the door 22 to an open position so that the drawer 92 may extend outward through the fascia to the customer side. Likewise when the drawer is retracted, the guide surfaces 112 move in engagement with the cam surfaces 98 as a result of the door 22 being biased toward a closed position. This is done in the exemplary embodiment by gravity. However, in other embodiments other biasing approaches may be used. As the drawer 92 moves rearward into the housing, the door 22 closes by rotating about the pivot 110. As the door 22 returns to the closed position the latch which comprises the movable members 106 again holds the door in the closed position. This is because the movable members deform by springing upward as the drawer is no longer in engagement therewith. As a result the upward engaging fingers of the movable members engage projections 108, holding the door 22 in a closed position.

Referring again to FIGS. 5 and 6, the exemplary drawer assembly 76 further includes a drive 114. Drive 114 is in operative connection with drawer 92 through a releasible connector 116. Drive 116 further includes a force limiting device 118. The force limiting device is operative to limit the amount of force imparted by the drive to move the drawer 92.

In the exemplary embodiment drive 114 includes a motor 120. Motor 120 is operative through a belt or other power transmission device to selectively rotate a drive screw 122. In the exemplary embodiment the force limiting device 118 comprises a clutch mechanism operatively connected between the motor 120 and the drive screw 122. In this way the force limiting device 118 limits the amount of force that is applied by the drive screw 122 to cause movement of the drawer 92.

Figure 8:
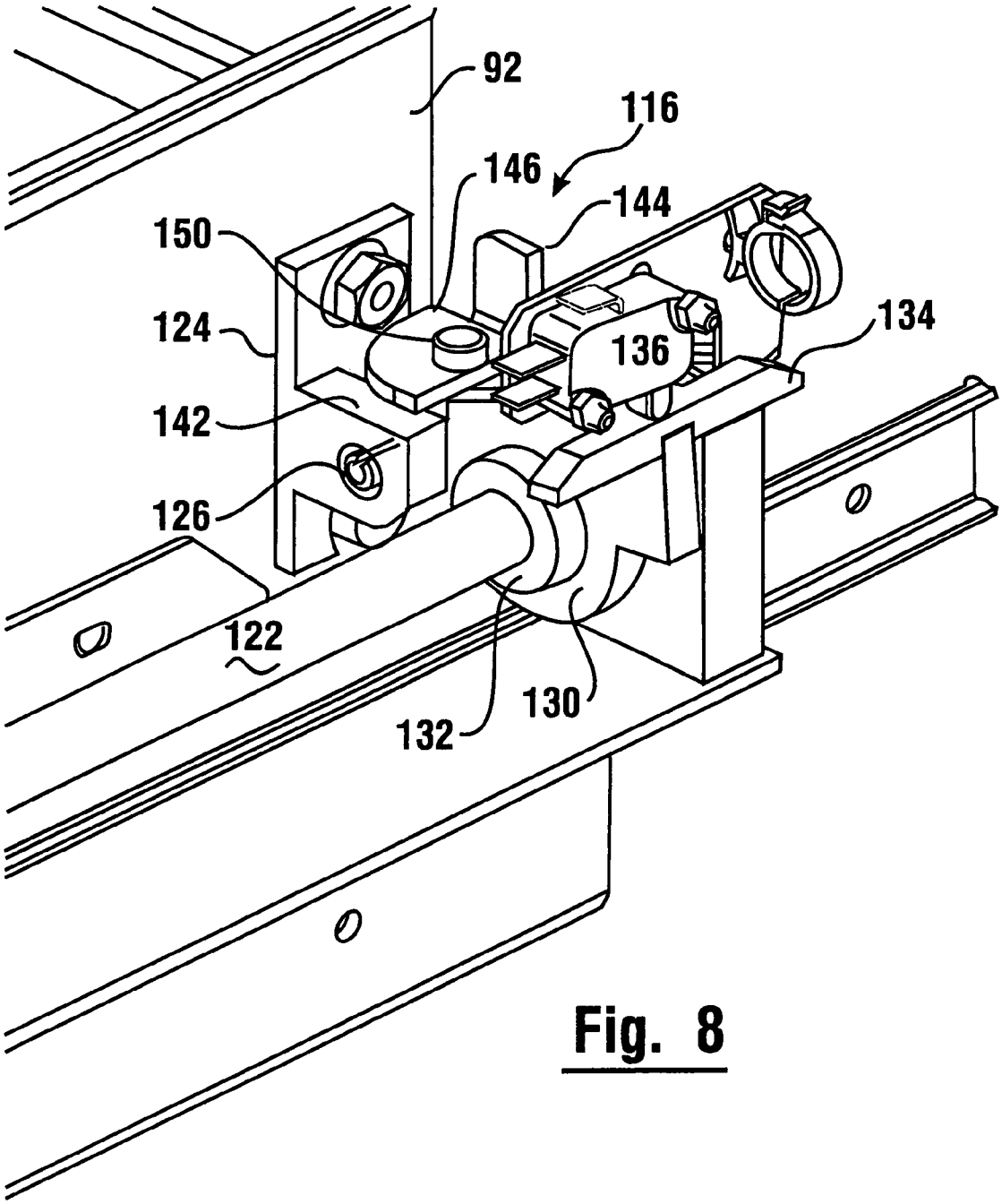
FIG. 8 is an isometric view of a releasible connector which connects the drive and the drawer.
Figure 9:
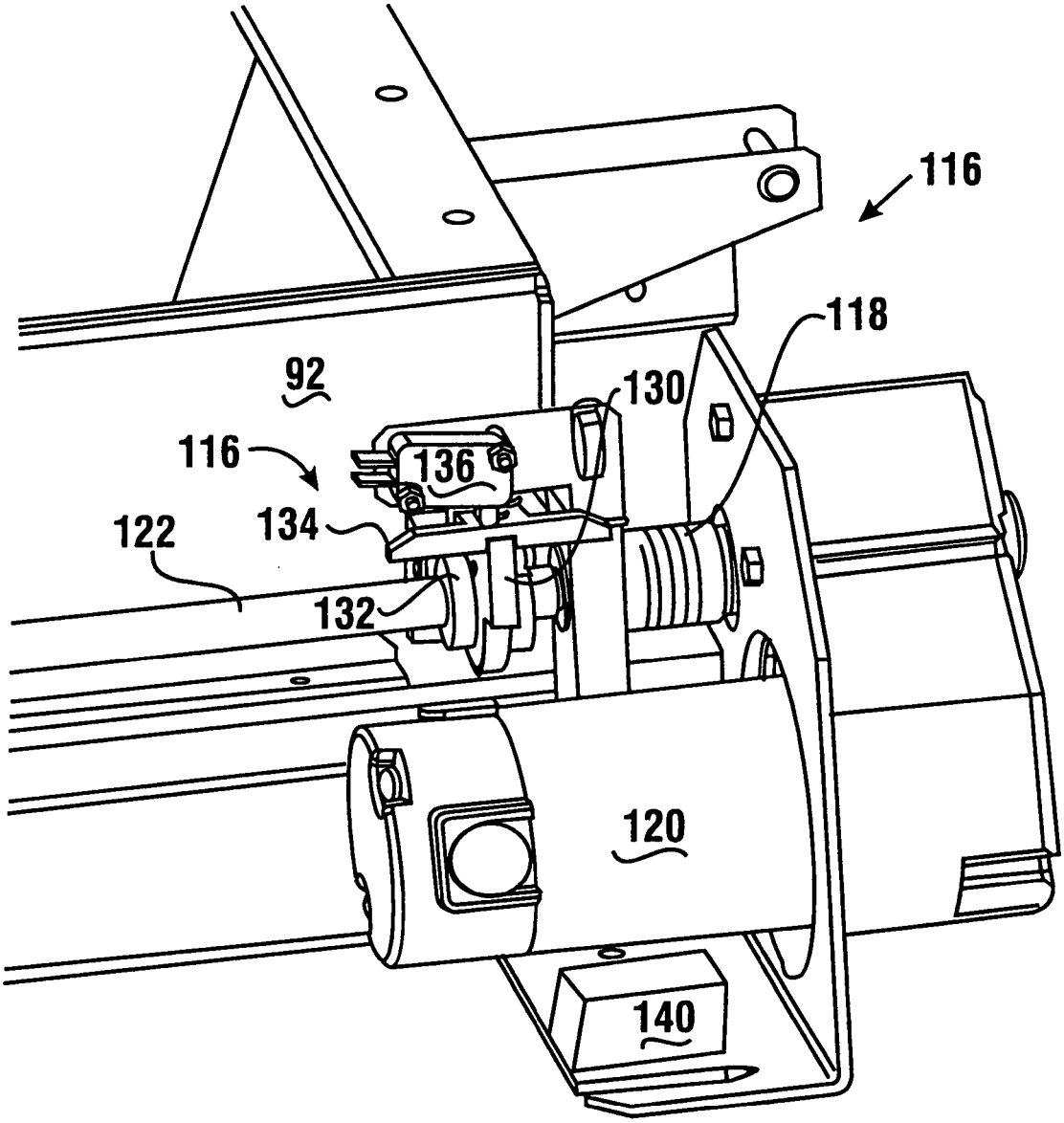
FIG. 9 is a further isometric view of the drive with the releasible connector and force limiting device.
Figure 10:
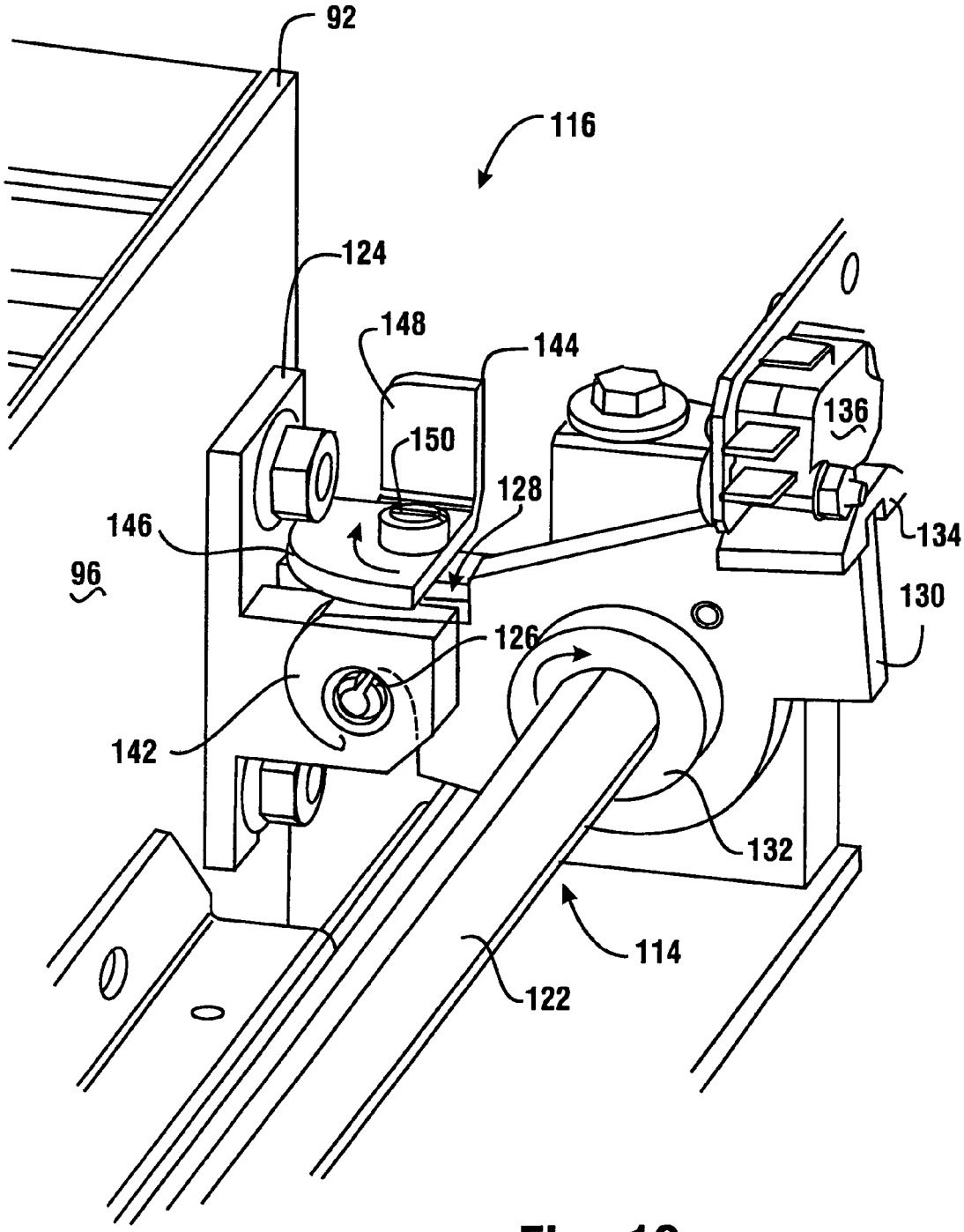
FIG. 10 is an enlarged view of the releasible connector which connects the drive and drawer.
Figure 11:
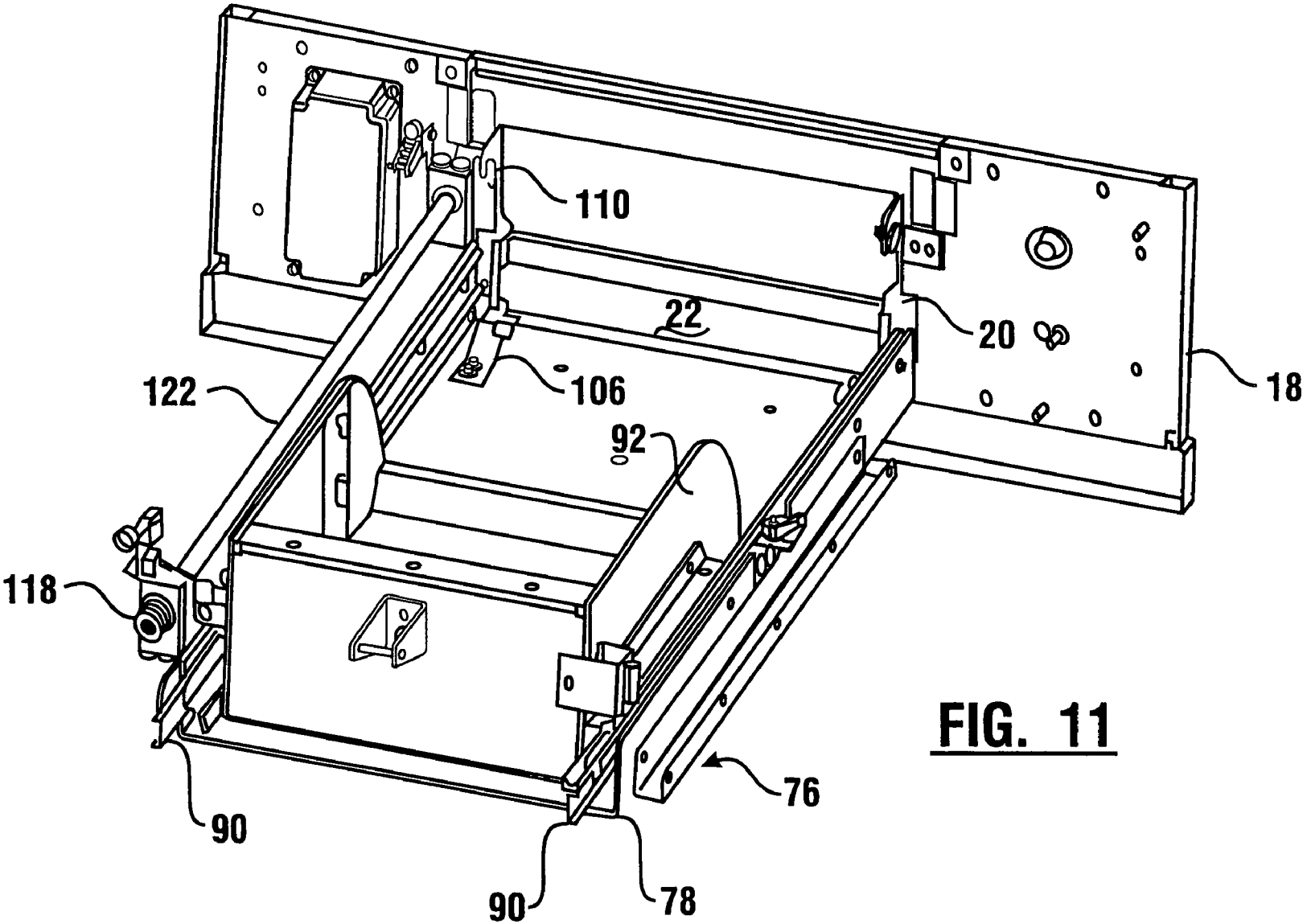
FIG. 11 is a rear isometric view showing the assembly and the fascia of the deal drawer apparatus.

As shown in more detail in FIGS. 8–10, the releasible connector 116 of the exemplary embodiment includes a yoke 124 that is operatively connected to a wall 96 of drawer 92. Yoke 124 is in supporting connection with a pin 126. Pin 126 extends in a recess 128 which is bounded by the body of the yoke.

A follower member 130 moves in response to rotation of drive screw 122. Follower member 130 includes a threaded nut portion 132 which threadably engages the drive screw. As a result, rotation of drive screw 122 in a first rotational direction causes the follower member to move along the drive screw toward the fascia portion of the deal drawer apparatus. Likewise rotation of the drive screw in an opposed rotational direction moves the follower member away from the fascia portion and inward toward the service provider side of the wall.

The follower member has in supporting connection therewith a switch engaging portion 134. The switch engaging portion is operative to engage a first switch 136 when the follower member is retracted to the inward extreme of its travel toward the service provider side. When the follower member moves outward toward the fascia portion and the customer side, the follower member eventually engages a second switch 138 (see FIG. 6). Switches 136 and 138 are operatively connected to motor 120 through a controller schematically indicated 140. As a result the extent of travel of the follower member 130 as well as the drawer 92 which is connected thereto is limited by the engagement of the switch engaging portion with switches 136 and 138 at its respective inward and outward extremes of travel.

As best shown in FIG. 10, the releasible connector 116 is enabled to be selectively disengaged from the drawer 92. This is accomplished in the exemplary embodiment through use of a hook portion 142 in supporting connection with follower member 130. Hook portion 142 is engageable in the recess 148 and is engageable with pin 126. A movable release lever 144 is movably mounted in supporting connection with the yoke 124. The release lever 144 includes a locking portion 146 that is movable to overlie the recess 128. As a result when the locking portion 146 overlies the hook portion 142 in the recess 128, the follower member 130 remains operatively engaged with the drawer 192.

Release lever 144 further includes a manual engaging portion 148. Manually moving the manual engaging portion 148 enables release lever 144 to rotate about a pivot 150. Release lever 144 pivots so that the locking portion 146 no longer overlies recess 148. The hook portion 142 can be rotated so as to no longer be engaged in the recess. This enables drawer 92 to be moved independent of the drive 114. It should also be noted that in the exemplary embodiment when the hook portion 142 is rotated so that it is no longer in recess 128, switch engaging portion 134 of the follower member no longer engages switches 136 and 138 at its extremes of travel. This further facilitates the ability of the drawer 92 to be moved independent of the drive without interfering with the control circuitry. An access door or other suitable opening may be provided in the housing for accessing the releasible connector.

In the exemplary embodiment the drawer 92 is in supporting connection with a releasible coupling 152 as shown in FIG. 7. Releasible coupling 152 is adapted to releasibly engage a manual movement device. In the exemplary embodiment the manual movement device comprises a handle 154. Handle 154 includes an inward end 156 which is adapted to releasibly engage a releasible coupling 152. The handle 154 is adapted to be installed through the elongated slot shown in FIG. 2. As a result if there is a malfunction of the drive 114, an operator or a serviceperson is enabled to release the connection between the drive and the drawer 92. The cover 46 is then removed to expose the elongated slot 44. The inward end of the handle 154 may then be engaged with the releasible coupling 152 through the slot. Thereafter the drawer 92 may be moved manually by an operator through movement of the handle 154 along the slot 44.

A useful aspect of the exemplary embodiment shown is that a malfunction of the drive does not render unusable the customer station which includes the deal drawer assembly. Rather a service provider is enabled to disconnect the drawer 92 from the drive and operate the drawer manually. This allows the service provider to continue servicing customers until the drawer assembly can be repaired or replaced.

Another aspect of the exemplary embodiment is that the drive and particularly the drive screw 122 extends horizontally adjacent to the drawer and on only one side. As a result the space required for the drive may be smaller than that for some other types of deal drawer assemblies. This has the advantage that it reduces the overall size of the assembly which may make it easier to install and service. In addition the positioning of the drive screw 122 and the yoke 124 near the rear of the drawer enables a relatively long length of travel of the front wall 102 of the drawer 92 beyond the opening 20 in the fascia. This results in the exemplary embodiment of the deal drawer assembly being relatively compact in the direction of drawer travel.

Another aspect of the exemplary embodiment is achieved through operation of the controller 140. In some applications it may be undesirable to start and stop the drawer 92 rapidly. For example if the drawer is used to hold medical items in bottles or containers, rapidly stopping the drawer 92 in its outward position may result in such items being thrown outward from the drawer. Likewise if items are being moved inward in any particular orientation or the items being moved are fragile, abrupt stopping of the drawer 92 in an inward position may cause undesirable results. To minimize undesirable results in certain applications, the controller may be operated to control the acceleration of the drawer 92. In the exemplary embodiment the controller 140 operates to control the speed of motor 120 and consequently the rotation of drive screw 122 so that the acceleration of the drawer from the rest position is relatively gradual. Likewise the deceleration of the drawer from its maximum velocity to the stop position is maintained relatively gradual. This minimizes the undesirable results from starting and stopping of the drawer too rapidly.

It should be appreciated that in embodiments of the invention the rate of acceleration and deceleration may be controlled through the controller 140 to suit the particular items that are being moved. For example in cases where the items being moved are fragile, it may be desirable to control acceleration and deceleration to be relatively gradual either when the drawer 92 is moving outward or in both inward and outward movement of the drawer. In other embodiments it may be desirable to have a slower acceleration and/or deceleration in only certain circumstances. Controls may also be provided in alternative embodiments on the control panel so as to allow the service provider to control the speed and/or acceleration of the drawer. As a result embodiments of the invention may have the rate of acceleration and speed of the drawer controlled based on the particular functions and circumstances in which the deal drawer apparatus is being operated. In alternative embodiments sensing devices may be provided so as to sense the content of the drawer and control the speed and acceleration characteristics thereof automatically in response thereto. Such sensors may include for example weight sensors or photo sensors for determining the weight, size and/or configuration of items in the drawer. In alternative embodiments sensors may be associated with clips for holding certain items such as credit cards or currency bills and drawer movement may be controlled in response to the presence or absence thereof. Alternatively areas for holding change such as pockets may be provided and drawer movement modified in response thereto. In further alternative embodiments holding areas for vials or bottles may be provided within the drawer and the sensors may be operative to sense such items positioned therein. The drawer may then change its movement characteristics in response to the presence of such items which may be damaged or spilled if the drawer accelerates or decelerates too abruptly. Numerous approaches for controlling properties of drawer movement in response to sensed or other inputs will be apparent to those having skill in the art based on the disclosure herein.

As represented in FIG. 5, the exemplary embodiment of the deal drawer apparatus 16 includes an interlock 158. Interlock 158 is operative to hold panel 42 in the closed, non-access position except when drawer 92 moves so that the interior area of the drawer is positioned below the upper opening 40 in upper wall 38. The interlock 158 then enables the panel 42 to be opened so that a service provider can put items into or remove items from the interior area of the drawer. Thereafter the interlock operates so that when the panel 42 is next moved to the non-access position, the panel is held therein until the drawer 92 is again moved outward and subsequently retracted below the opening.

Figure 13:
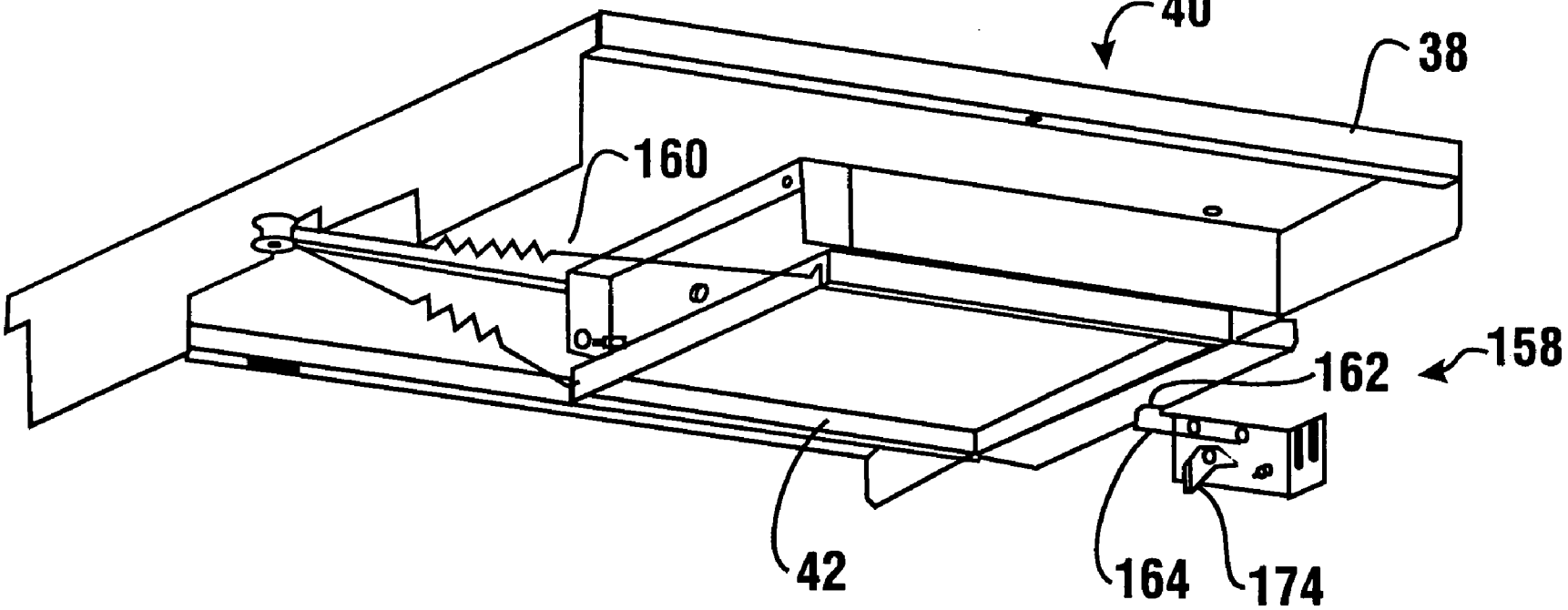
FIG. 13 is a bottom isometric view showing the upper portion of the housing and the upper opening therein, as well as the mounting of the panel which is movable to provide access to the deal drawer through the upper wall of the housing.

FIG. 13 shows the lower portion of upper wall 38 of housing 36 in the exemplary embodiment. Panel 42 is movably mounted in supporting connection with upper wall 38. In the exemplary embodiment panel 42 is movable from a non-access position shown in FIG. 13 in which the panel 42 closes the upper opening 40 in wall 38, to an access position in which panel 42 is disposed forward from the position shown in FIG. 13 and in which items may be passed through opening 40. Panel 42 in the exemplary embodiment is in operative connection with a spring mechanism schematically indicated 160. Spring mechanism 160 is operative to bias panel 42 towards the access position. As represented in FIG. 13 the lower surface of panel 42 includes an aperture 162. Aperture 162 is engageable with a first moving part 164 which is operative to hold panel 42 in the non-access position, and to release the panel 42 so that it may move to an access position in response to the drawer 92 moving so that the interior area thereof is positioned beneath opening 40.

Figure 14:
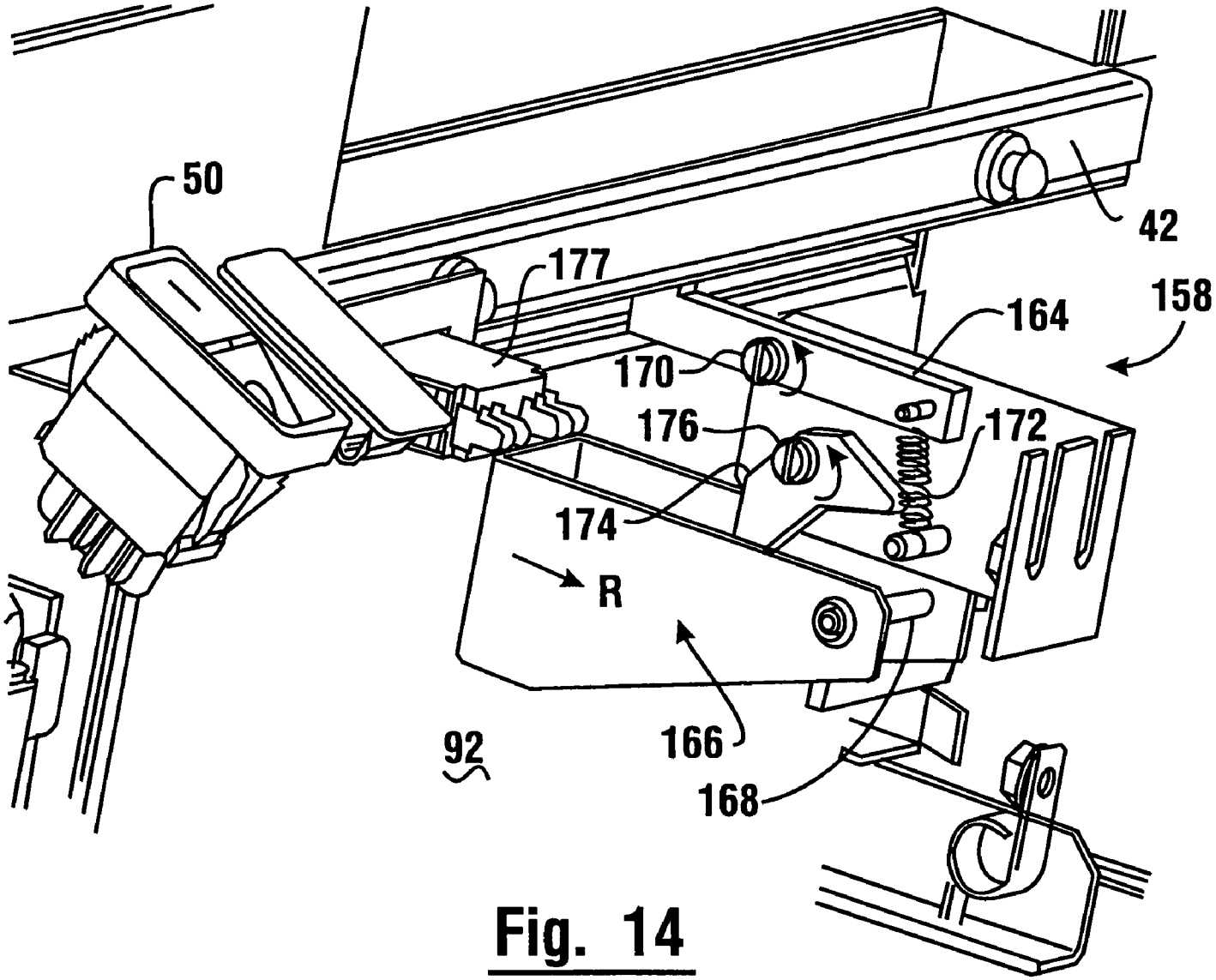
FIG. 14 is an enlarged view of the interlock which operates to hold the panel in a non-access position until the interior area of the drawer is retracted to a position below the upper opening.
Figure 15:
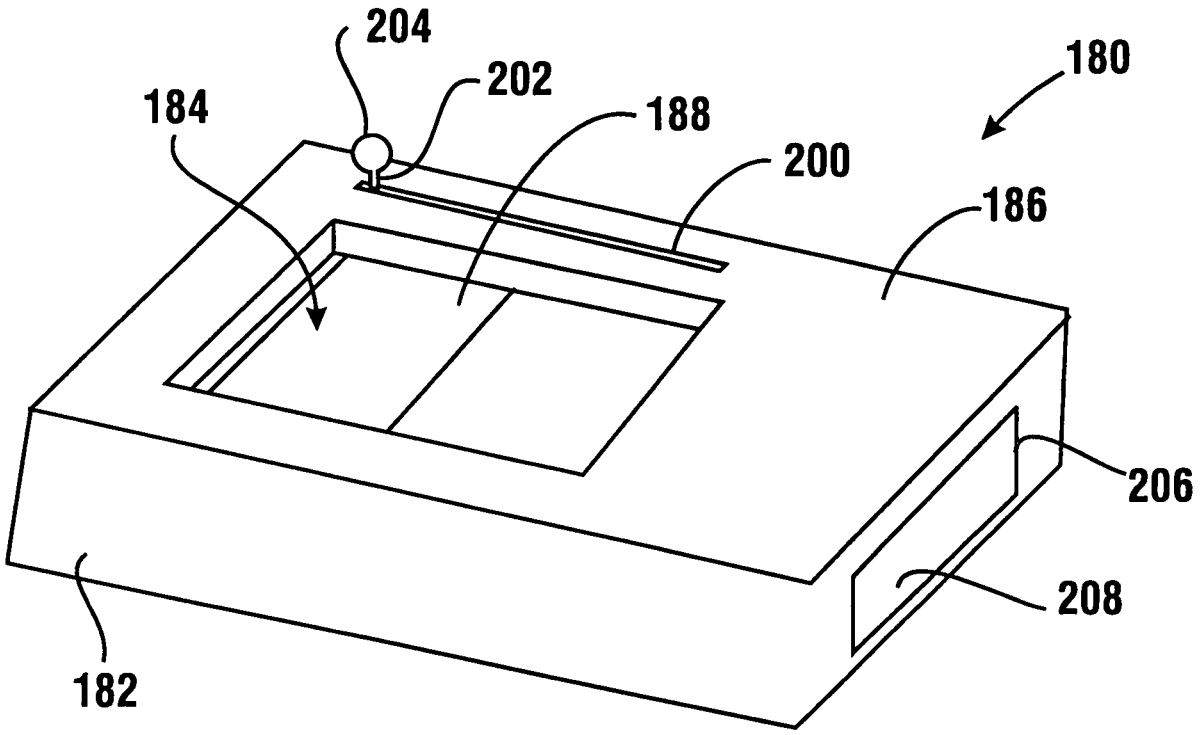
FIG. 15 is an isometric view of an alternative embodiment of a deal drawer apparatus in which the drawer is manually movable.

As shown in FIG. 14 drawer 92 includes an actuator portion 166 that extends from the rear thereof. Actuator portion 166 includes an actuating pin 168. Interlock 158 includes the first moving part 164 which is rotatable about a pivot 170. A spring 172 is operative to bias first moving part 164 to engage the aperture 162 in panel 42 so as to hold the panel in the non-access position.

Interlock 158 further includes a second moving part 174. Part 174 is movable about a pivot 176. As can be appreciated from FIG. 14, when the drawer 92 is extended outward through the opening 20 in the fascia, the panel 42 is held in the non-access position by the engagement with part 164. When the drawer 92 is retracted, the actuating pin 168 on the actuator portion eventually engages part 174 below the pivot 176. In response to movement of drawer 92, part 174 acts as a cam and engages part 164 so as to rotate part 164 counterclockwise as shown about its pivot 170. This causes part 164 to disengage aperture 162 in the panel 42. In response to such disengagement, the panel 42 responsive to the force of spring mechanism 160 is moved forward below the upper wall 38. The movement of the panel occurs as the interior area of the drawer 92 comes generally into alignment with the upper opening 40 in the upper wall 38. As a result the service provider is enabled to either put items into or remove items from the interior of drawer 92.

As can be appreciated, in this embodiment as drawer 92 moves in the direction of arrow R shown in FIG. 14, the actuating pin 168 moves beyond the position necessary to open panel 42. Once the actuating pin 168 is moved beyond part 174, part 164 is again positioned through operation of the spring 172, so that it may engage panel 42 in the closed position. As a result when the service provider has completed adding or removing items from the interior area of the drawer, the service provider may move the panel 42 from the access position to the non-access position in which the panel 42 again closes the opening 40. When the panel 42 is again moved to the non-access position, the part 164 engages the aperture 162 and holds the panel 42 in the closed position.

A panel sensor 177 is positioned to sense whether the panel 42 is in the open or closed position. The panel sensor is in operative connection with the controller 140. Upon sensing that the panel 42 is in the closed position, the controller enables the drawer 92 to again be moved outward by the drive in response to an input to the actuatable control device 50 on the control panel.

As can be appreciated from FIG. 14, actuating pin 168 is enabled to move in the outward direction and to rotate part 174 in a clockwise direction as shown, without changing the position of part 164. Once the actuating pin 168 has moved past the part 174, part 174 returns to a position where it can again engage pin 168 and the pin moves inward. In the exemplary embodiment this is done in response to a biasing force provided by gravity and is due to the configuration of part 174 and the position of pivot 176. Of course in other embodiments other approaches to controlling the position of the movable parts may be used.

In operation of the exemplary embodiment of the apparatus 16, the panel 42 may initially be either in a non-access position or in the access position. This may depend on whether the first step in the transaction to be conducted typically involves the service provider delivering something to the customer or the customer delivering something to the service provider. In the case of the exemplary system shown, it will be assumed that the customer will first deliver something to the service provider. This might be for example the customer's bank book, when the deal drawer apparatus is used in a banking transaction environment. In this circumstance the panel 42 would be maintained in a non-access position.

When a customer is at the station 10, the service provider may notice the customer or the customer may call the service provider by pressing the call button 28. In response the service provider may have a discussion with the customer through the microphone and speaker assemblies 24, 56 to determine if the customer wishes to conduct a transaction. Alternatively the service provider may actuate the actuatable control device 50 so as to move the drawer 92 outward through the opening 20 from the fascia portion 18. This may be done through operation of the drive 144 and the controller 140. Of course as previously mentioned, the drive will not operate to move the drawer 92 outward unless the panel 42 is sensed as closed by the panel sensor 177.

The drive 114 moves the drawer 92 outward until the drawer is sensed as reaching the switch at its outward extreme of travel. The customer may now place items in the interior area of the drawer. Alternatively in cases where the transaction begins with the service provider providing something to the customer, the customer may remove items from the drawer. In the exemplary embodiment after the customer has placed the items in the drawer, the service provider may retract the drawer through an appropriate input through the actuatable control device 50. The drawer then moves inward to its inward extreme of travel. As the drawer does so, it actuates the interlock 158 so as to enable the panel 42 to move to the access position. With the panel in the access position, a service provider is enabled to remove items from the interior area of the drawer 92.

The service provider may conduct activities related to the items provided by the customer, provide additional items or do other activities on the service provider side of the wall. When the service provider has completed these activities, typically the service provider will need to deliver at least one item to the customer. To do this the service provider places the item in the interior area of the drawer through the opening 40. The service provider may then move the panel 42 to the non-access position. In response to sensing that the panel 42 has been closed, the controller 140 allows the service provider to move the drawer outward through an appropriate input to the actuatable control device 50. In response the drawer 92 again moves outward, unlatches and opens the door 22 in doing so, and extends so that the interior area of the drawer is accessible to the customer at the customer station. This may be done additional times until the customer and the service provider complete the transaction.

It should be noted that in the exemplary embodiment of the deal drawer apparatus, a malfunction of the drive 114 will not place the customer station 10 out of service. Rather the service provider or a service person may access the drawer assembly and disengage the releasible connector 116 which connects the drive and the drawer 92. This may be done in various embodiments with features such as an access panel indicated in FIG. 2 and underlying opening 39 through the housing to disengage the releasible connector or other suitable means. In the exemplary embodiment, the user may remove the cover 46 and engage the handle 154 with the drawer 92 through the releasible coupling 152. Thereafter the service provider may selectively move the drawer between its inward and outward positions by movement of the handle relative to the elongated slot 44. The service provider may continue to operate the deal drawer assembly in this manner until the drive is repaired.

A further aspect of the exemplary embodiment is the ability to remove and replace the drawer assembly 76 as previously discussed. A service person is enabled to relatively rapidly and accurately place the drawer assembly of the exemplary embodiment in the housing so as to achieve the proper operation.

A further aspect that is useful in the exemplary embodiment is that the force that is applied by the drive to moving the drawer is limited. As a result if the drawer should be inhibited in its outward movement by engagement with a vehicle or other obstruction, the force limiting device 118 will slip rather than cause excessive damage to the obstruction or to the mechanism. Likewise the force limiting device of the exemplary embodiment prevents damage due to obstructions which may be encountered during inward movement of the drawer.

A further useful aspect of the exemplary embodiment is the generally secure and reliable operation of a latch mechanism which controls the opening of the fascia door 22. When the drawer 92 is not extended outward from the fascia, the door 22 is held in the closed position. This will generally serve to prevent a criminal on the customer side of the wall from sticking a weapon or other material into the housing. In the exemplary embodiment the door 22 is only unlatched responsive to the drawer 92 being in proximity thereto and in a position in which unauthorized items are prevented from being extended to an area adjacent to the service provider. The screw drive of the exemplary embodiment also aids in security by making it more difficult for a person on the customer side of the wall to force the drawer to move in either direction.

The exemplary form of the invention also provides a compact unit. The unit is also relatively easy to install in supporting connection with a wall including walls of different thicknesses. The exemplary embodiment also includes reliable and economical construction to facilitate long periods of operation without a need for service or repair.

An alternative embodiment of a deal drawer apparatus indicated 180 is shown in FIGS. 15–23. Deal drawer apparatus 180 may include features of the embodiments previously described or alternative or additional features. Deal drawer apparatus 180 in contrast to apparatus 16 is adapted primarily for manual operation. However, the features described may also be used in embodiments of the invention which operate using a motor or other drive mechanism.

Deal drawer 180 includes a housing 182. Housing 182 houses a manually movable drawer which is selectively movable by a service provider. Housing 182 includes an upper opening 184 in a top portion 186. Access through upper opening 184 is controlled by a movable panel 188 which in this exemplary embodiment is comprised of a plurality of movable panels as later discussed.

Top portion 186 further includes an opening 200 which comprises an elongated slot. A handle 202 is operatively connected to the movable drawer mechanism and extends outward through the opening 200. Handle 202 includes a knob 204 to facilitate grasping of the handle by a service provider and moving the handle and thus the connected drawer, inward and outward to carry out transactions.

Deal drawer apparatus 180 also includes a front opening 206 through which the drawer may be selectively extended by the service provider. Front opening 206 has access thereto controlled by a movable door 208. Door 208 may be in operative connection with latches or other mechanisms of the type previously described so as to reduce the unwanted opening thereof when the door is in the retracted position.

Figure 16:
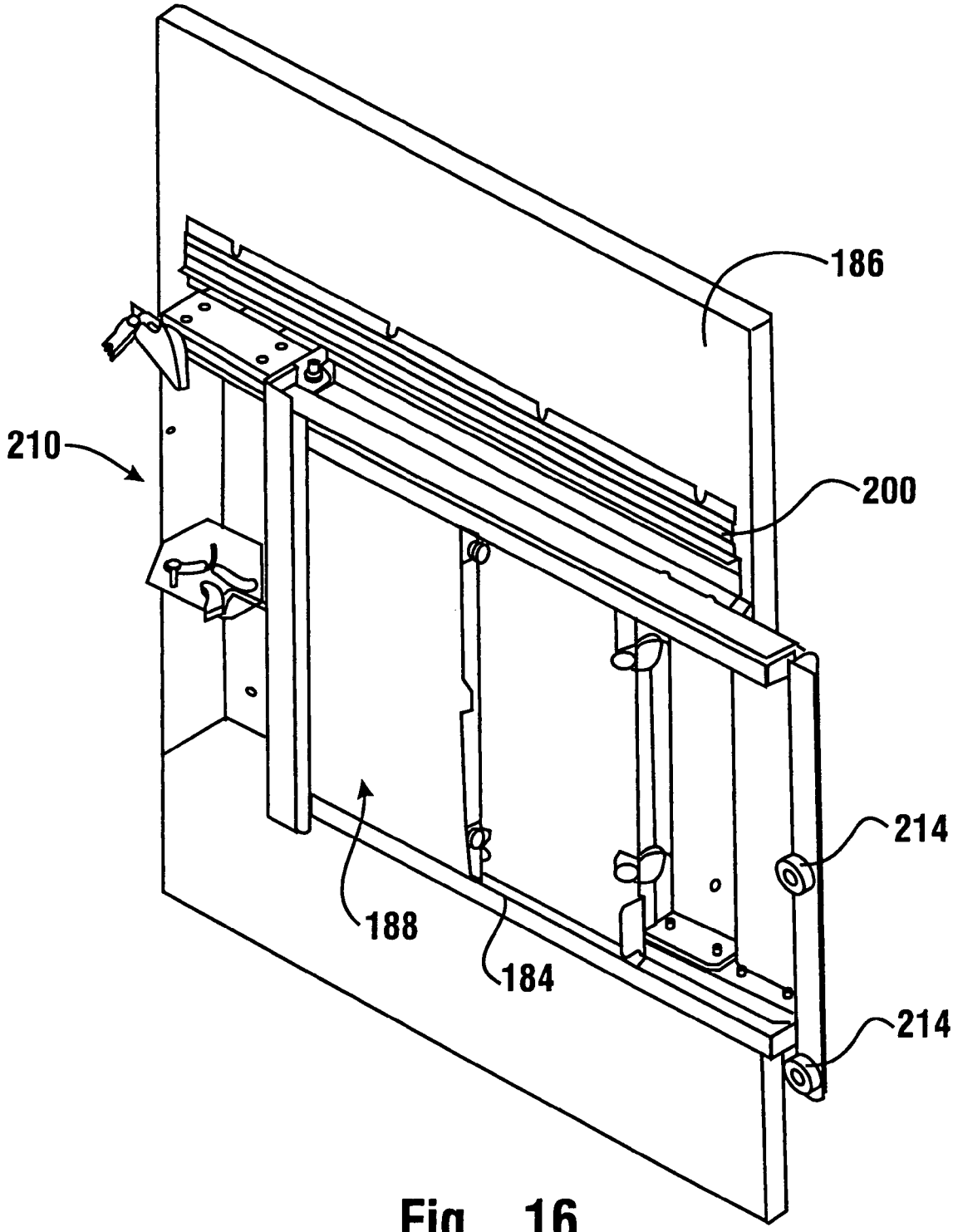
FIG. 16 is a bottom isometric view of the top cover of the deal drawer shown in FIG. 15.
Figure 17:
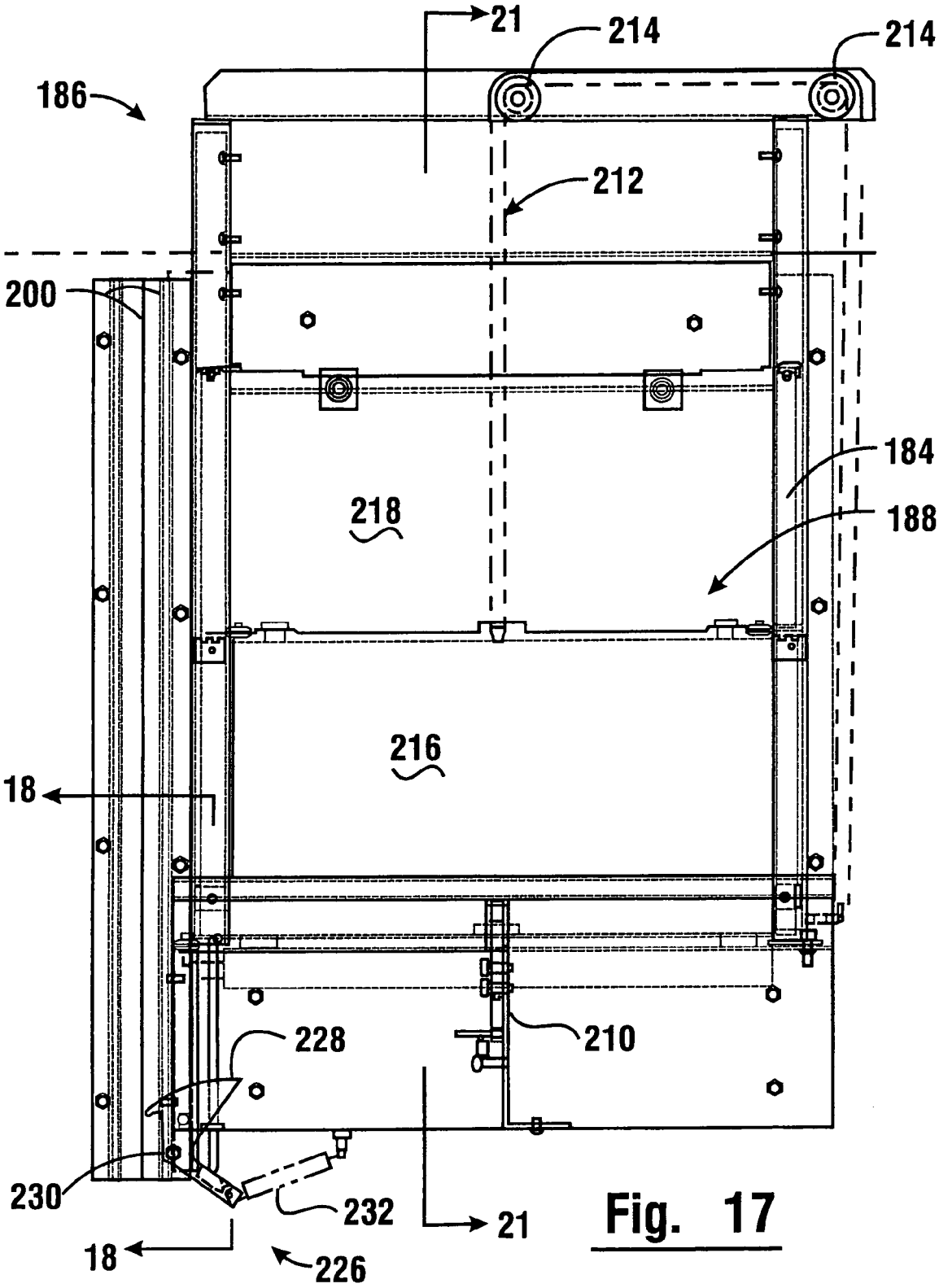
FIG. 17 is a plan view of the top cover viewed in an upward facing direction.

As shown in FIGS. 16 and 17, top portion 186 has operatively connected thereto a panel interlock 210. Panel interlock 210 in the exemplary embodiment may be similar to the panel interlock previously described and is operative to hold the panel 188 in a closed position except when the drawer moves from an extended position to a retracted position. As the drawer moves to the retracted position, the panel interlock 210 is operative to momentarily release the panel 188 from being held in the closed position. When this occurs, an elongated spring 212 is operative to move the panel 188 from the closed non-access position to the open or access position. In this exemplary embodiment spring 212 is supported on roller supports 214. Roller supports 214 enable spring 212 to extend around the front portion of the housing and rearward toward the back or interior portion of the housing. In this way the exemplary form of spring 212 provides for substantial spring force while minimizing the overall size of the housing. Of course it should be understood that this embodiment is exemplary, and in other embodiments other types of springs and/or other approaches may be used.

Figure 21:
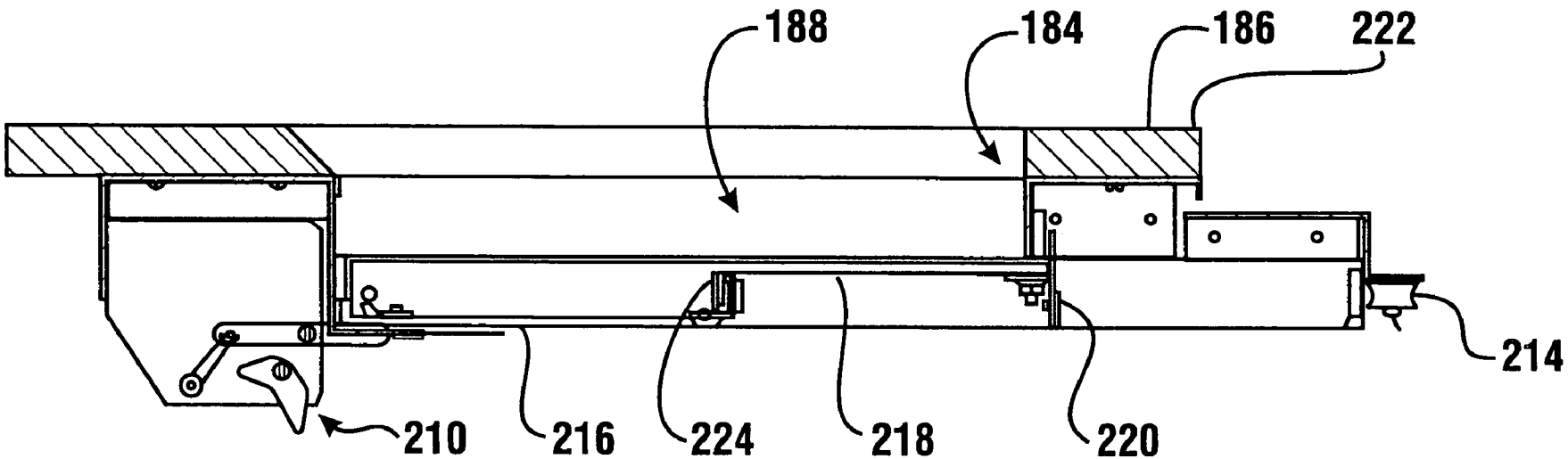
FIG. 21 is a side cross sectional view taken along lines 21—21 in FIG. 17.
Figure 22:
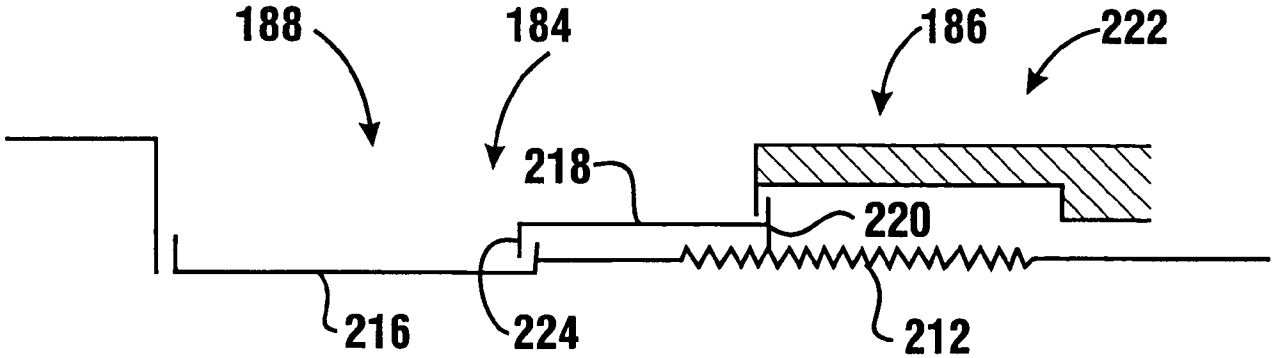
FIG. 22 is a side schematic view showing the access panel of the alternative embodiment in a non-access position.
Figure 23:
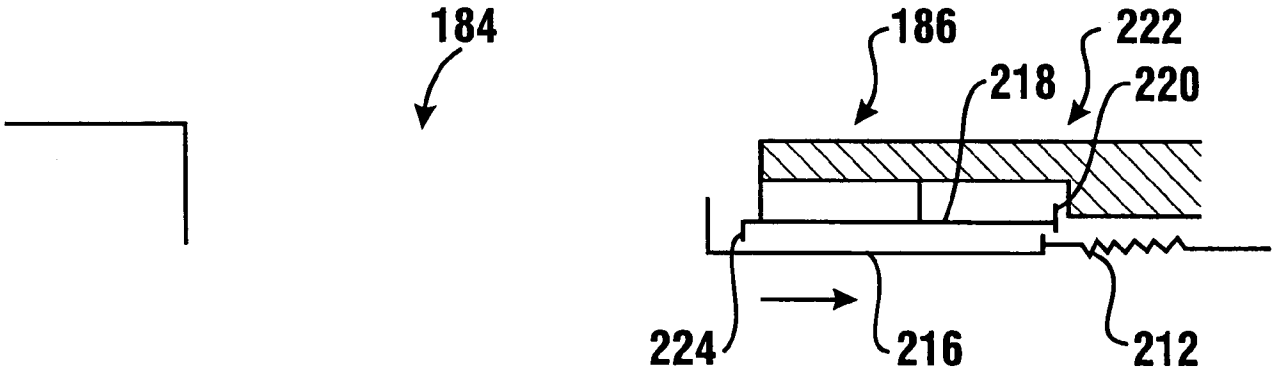
FIG. 23 is a view similar to FIG. 22 but with the access panel moved to an access position.

As best shown in FIGS. 21 through 23, the exemplary embodiment of deal drawer apparatus 180 has a panel comprised of a pair of panel members 216, 218. In the exemplary embodiment panel members 216 and 218 are arranged in relatively movable overlying relation. This enables the overlying panel members to move both with respect to the housing as well as with respect to one another as they move between the access and non-access positions. For example FIG. 22 shows panel members 216 and 218 closing the opening 184 such that the panel is in a non-access position. When the drawer moves to the retracted position the panel interlock 210 is operative to release panel 216 to move responsive to the biasing force of spring 212. Panel 216 moves in a forward direction responsive to the biasing force of the spring. The movement of panel 216 engages tabs 220 which extend inward from panel member 218. This moves panel member 218 with panel member 216 beneath a forward portion 222 of the top portion 186 as shown in FIG. 23. As can be appreciated this configuration allows the forward portion 222 to occupy a shorter lineal distance than would otherwise be required to retract a single unitary panel of sufficient length to cover opening 184.

As can be appreciated when a service provider wishes to move the panel 188 to the non-access position, panel member 216 is moved to the left from the position shown in FIG. 23. This causes tabs 224 on panel member 218 to engage panel member 216, thereby moving panel 218 to the non-access position shown in FIG. 22.

It should be understood that this arrangement of relatively movable panel members is exemplary and in other embodiments other approaches may be used. Such approaches may include for example, folding panel members, panel members that are flexible and which can be turned or rolled for purposes of retraction or other type closure members.

As shown in FIG. 17, the exemplary embodiment of deal drawer apparatus 180 includes a drawer interlock referred to as 226. The drawer interlock 226 is operative in the exemplary embodiment to prevent the holding area in the drawer from being moved from the position underlying opening 184 unless the panel 188 has been first moved to the non-access position. This reduces the risk that the drawer will be moved at times when items or appendages may be extending into the opening 184. This also enhances security for the service provider by reducing the risk that the drawer can be pulled outward by someone accessing the front opening 206.

In the exemplary embodiment the drawer interlock comprises a movable member 228. Member 228 is movable about a pivot 230. Movable member 228 is biased in a counterclockwise direction as shown in FIGS. 17, 19 and 20 by a biasing member or spring 232.

Figure 20:
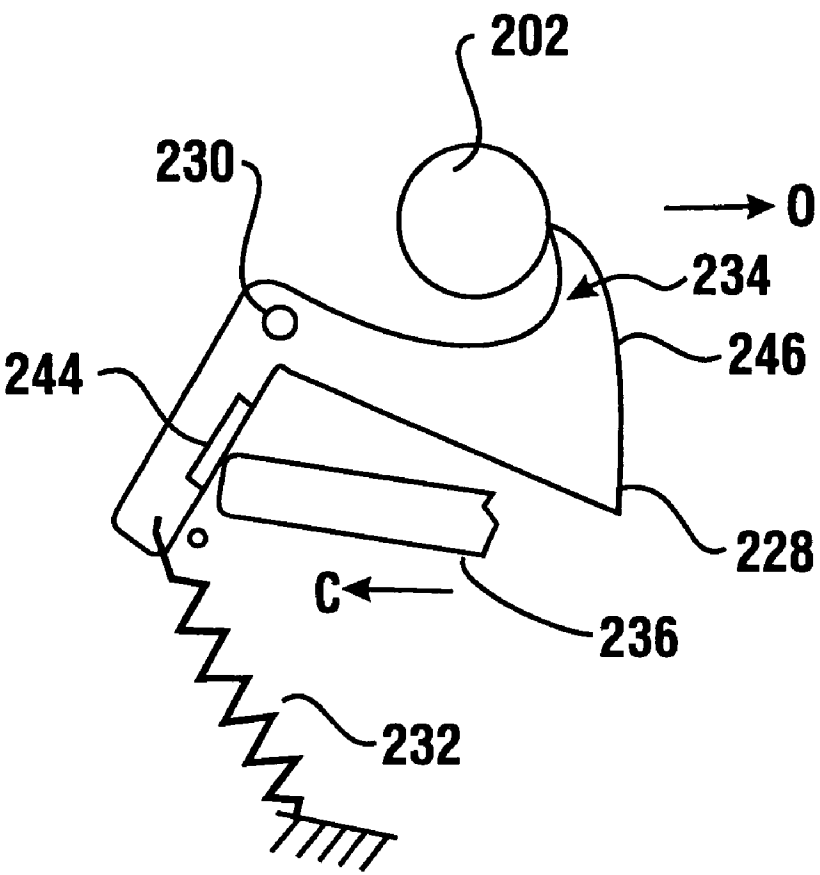
FIG. 20 is a view similar to FIG. 19 but with the movable member in a passing position in which the drawer is enabled to move to an extended position.
Figure 19:
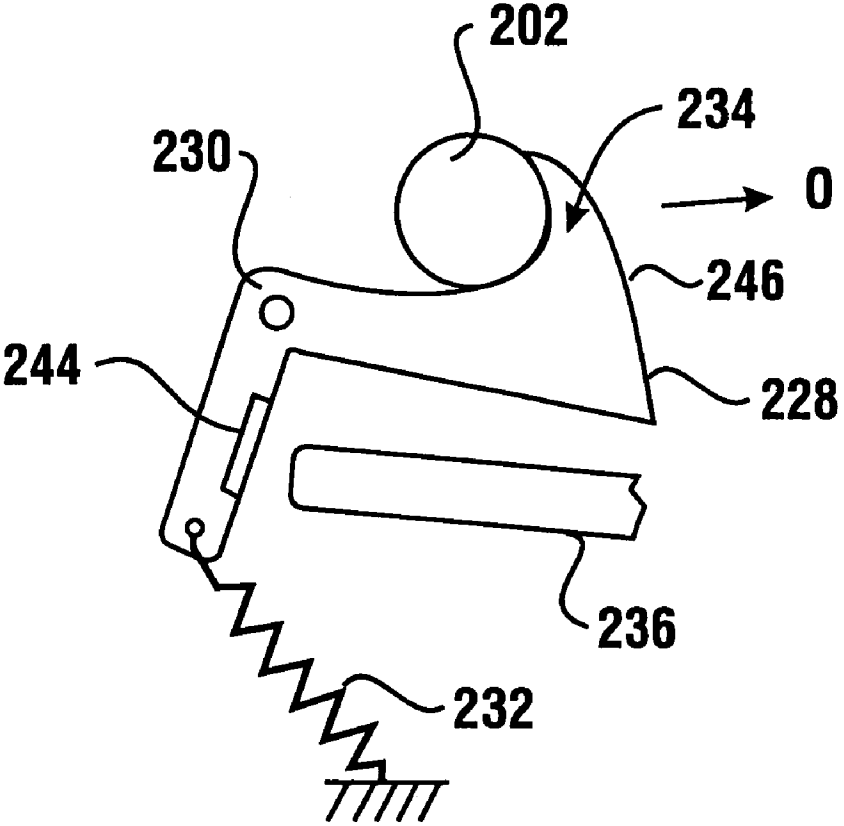
FIG. 19 is a schematic view of a movable member in a blocking position in which movement of the drawer to an extended position is prevented.

As best shown in FIGS. 19 and 20, member 228 includes a hook portion 234. In the exemplary embodiment hook portion 234 is configured to engage the handle 202 or a portion thereof which is in operative connection with the drawer. However, it should be understood that although the exemplary embodiment of the drawer interlock operates to engage a handle, in other embodiments other members operatively connected to the drawer may be engaged in a similar manner.

Figure 18:
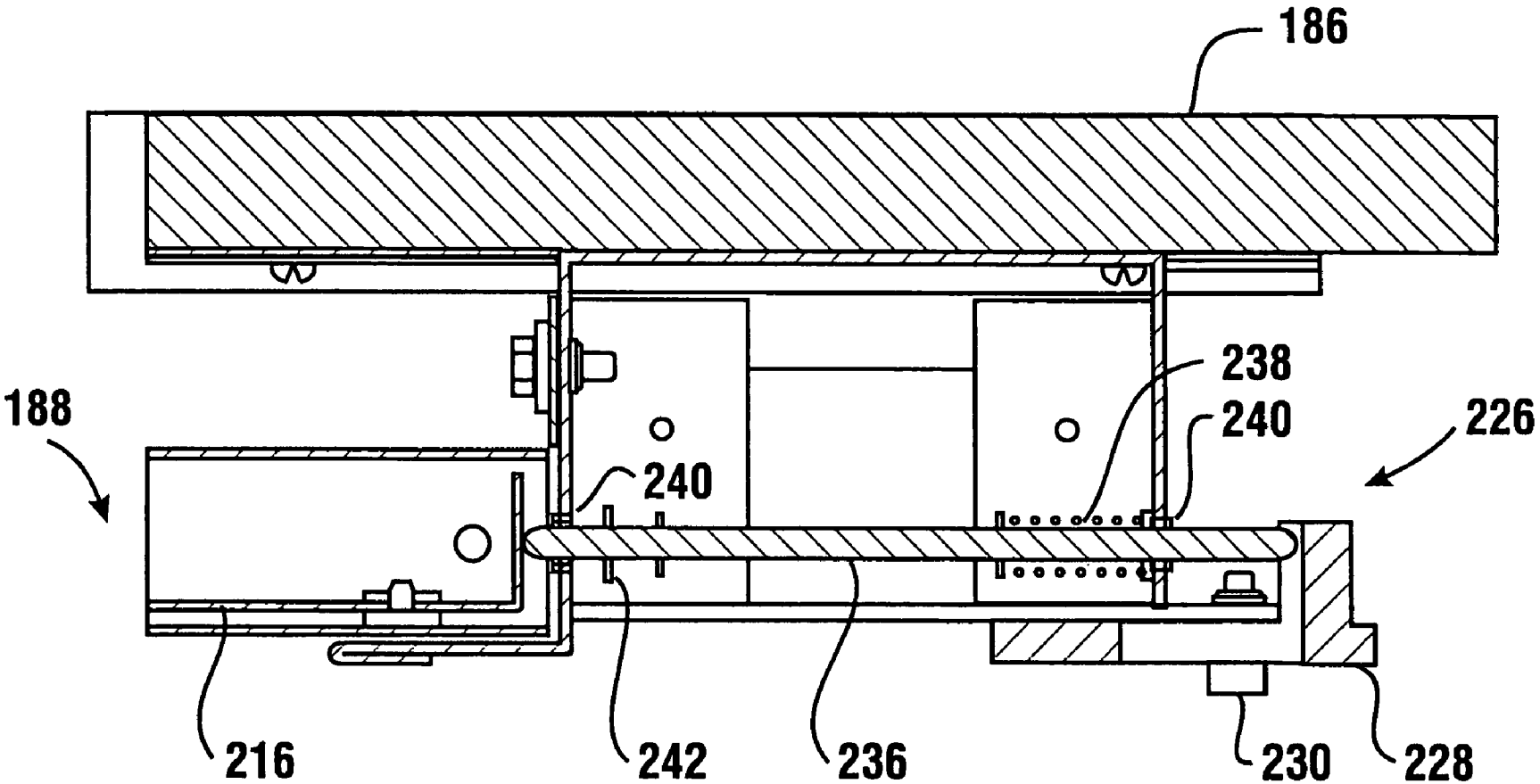
FIG. 18 is a cross-sectional side view along line 18—18 in FIG. 17.

The exemplary drawer interlock 226 further includes a movable push rod 236 as shown in FIG. 18. Push rod 236 is biased toward the left as shown in FIG. 18. Push rod 236 is supported in bushings 240 and is limited in its movement in response to the biasing force of spring 238 by a stop ring 242.

Push rod 236 is adapted to engage panel member 216 when the panel 188 is in the non-access position as is shown in FIG. 18. In this position the push rod 236 is moved against the biasing force of spring 238. As a result moving the panel 188 to the access position causes the push rod 236 to be displaced toward the rear of the housing which is to the right as shown in FIG. 18.

As represented in FIGS. 19 and 20, member 228 includes in operative connection therewith a tab portion 244. Tab portion 244 is sized to engage the push rod 236 when the push rod is moved rearward in response to the panel 188 being in the non-access position.

As can be appreciated from FIGS. 19 and 20, when the panel 188 is open so as to be in the access position, the push rod 236 is disposed to the right as shown, the movable member 228 is moved responsive to the biasing force of spring 232 in a counterclockwise direction. In this position the hook portion 234 engages the handle 202 in generally an over center position. As a result the member 228 prevents movement of the handle and the drawer which is operatively connected thereto in the direction of arrow O as shown. This prevents the drawer from being moved outward when the panel is in the access position.

When the panel 188 is moved to the closed or non-access position, the push rod 236 is moved rearward in the direction of arrow C shown in FIG. 20. Such movement causes the push rod to engage tab 244 in connection with member 228. This moves the member 228 against the force of spring 232. As a result of such movement, the hook portion 234 is no longer disposed in over center relation of the handle 220. In this passing position, the handle is enabled to move in the direction of arrow O by engaging and moving member 228 clockwise about pivot 230. As can be appreciated, in this passing position the exemplary member 228 acts as a detent so as to prevent unintended movement of the drawer in an outward direction while enabling deliberate movement of the drawer by the service provider.

As can be appreciated when the drawer is moved from an extended position to a retracted position, the handle 202 is operative to engage a contoured lead surface 246 on the hook portion 234. This lead surface provides cam action and enables the handle 202 to again move the drawer to the retracted position. In the exemplary embodiment the member 228 acts as a detent to help assure that the drawer has been fully retracted by the service provider and to lightly hold the drawer in the retracted position until the panel 188 is opened. When the panel 188 is moved to the access position, the drawer interlock again prevents outward movement of the drawer.

It should be understood that this arrangement of the drawer interlock is exemplary and in other embodiments other approaches within the scope of the invention may be used. It should also be understood that the drawer interlock shown is not necessarily limited to use in manually driven deal drawer devices. Such mechanical interlocks may be used in conjunction with motor driven deal drawers such as that previously described. Such interlocks may be used in conjunction with a removable handle device which is intended to be connected to the drawer only in cases of malfunction. Alternatively such a mechanical interlock may be used to hold the deal drawer in position in circumstances when a motorized or other type drive is used. Numerous approaches within the scope of the invention will be apparent to those having skill in the art.

Thus the exemplary embodiments of the deal drawer apparatus having features of the present invention achieve one or more of the above stated objectives, eliminate difficulties encountered in the use of prior devices and systems, solve problems, and attain the desirable results described herein.

In the foregoing description certain terms have been used for brevity, clarity and a understanding, however no unnecessary limitations are to be implied therefrom because such terms are for descriptive purposes and are intended to be broadly construed. Moreover, the descriptions and illustrations herein are by way of examples and the invention is not limited to the details shown and described.

In the following claims any feature described as a means for performing a function shall be construed as encompassing any means capable of performing the recited function, and shall not be deemed limited to the particular means shown in the foregoing description or mere equivalents thereof. The inclusion of an Abstract herein shall not in any way be construed as limiting the invention to features described or referred to in such Abstract.

Having described the features, discoveries and principles of the invention, the manner in which it is constructed and operated, and the advantages and useful results attained; the new and useful structures, devices, elements, arrangements, parts, combinations, systems, equipment, operations, methods, processes, and relationships are set forth in the appended claims.

I claim:

1. A deal drawer apparatus comprising:

a housing including an upper opening and a front opening;

a drawer movably mounted in supporting connection with the housing, the drawer having an interior area and wherein the drawer is movable between a first position wherein the interior area is aligned with the upper opening, and a second position wherein the drawer is moved outward through the front opening;

a panel movably mounted in supporting connection with the housing, wherein the panel is movable between a non-access position wherein the panel blocks access through the upper opening and an access position wherein the panel enables access through the upper opening;

a drawer interlock, wherein the drawer interlock comprises a member including a hook portion, wherein in the access position of the panel the hook portion is positioned to prevent the drawer from moving from the first position, wherein the drawer interlock prevents the drawer from moving from the first position unless the panel is in the non-access position.

2. The apparatus according to claim 1 wherein the panel and the member are in operative connection, and wherein in the non-access position the hook portion is disposed to enable movement of the drawer from the first position toward the second position.

3. The apparatus according to claim 1 and further comprising a handle in operative connection with the drawer, and wherein the drawer is movable between the first and second positions responsive to movement of the handle, and wherein when the panel is in the access position the hook portion engages the handle to prevent movement of the drawer from the first position.

4. The apparatus according to claim 3 wherein the member is rotatably movable about a pivot, and wherein the member is rotatably movable responsive to the panel such that when the panel is in the non-access position, the hook member is in a passing position in which the handle is enabled to engage and rotate the member and the drawer is enabled to move from the first position, and wherein when the panel is in the access position, the hook member is in a blocking position such that the handle is unable to rotate the member, whereby the drawer is prevented from moving from the first position.

5. The apparatus according to claim 4 and further comprising a spring operative to bias the member toward the blocking position.

6. The apparatus according to claim 5 and further comprising a push rod operatively disposed intermediate of the panel and the member, wherein movement of the push rod is operative to cause the member to move between the passing and blocking positions.

7. The apparatus according to claim 6 wherein the panel comprises at least two overlying movable panel members.

8. The apparatus according to claim 7 and wherein the housing includes a forward portion, wherein the at least two overlying movable panel members are movable beneath the forward portion in the access position of the panel.

9. The apparatus according to claim 8 and further comprising a panel interlock, wherein the panel interlock is operative to hold the panel in the non-access position when the drawer is in the second position.

10. The apparatus according to claim 9, wherein the panel interlock is operative to release the panel from being held in the non-access position when the drawer is in the first position.

11. The apparatus according to claim 9 and further comprising a further spring in operative connection with the panel, wherein the further spring is operative to bias the panel toward the access position.

12. The apparatus according to claim 11, wherein the panel interlock is operative to release the panel to move momentarily as the drawer moves to the first position, and wherein the panel is operative to move toward the access position responsive to the momentary release of the panel interlock.

13. The apparatus according to claim 12, wherein the panel interlock is operative to hold the panel in the non-access position responsive to the panel being moved to the non-access position while the drawer is in the first position.

14. The apparatus according to claim 13, wherein the panel interlock comprises a first moving part, wherein the first moving part is biased to operatively engage the panel in the non-access position, and wherein the first moving part operatively disengages the panel when the drawer moves to the first position.

15. The apparatus according to claim 14, wherein the panel interlock further comprises a second moving part, wherein the second moving part is moved in a first direction responsive to the drawer moving from the second position to the first position, wherein movement of the second moving part in the first direction is operative to cause the first moving part to operatively disengage the panel, and wherein responsive to the drawer moving from the first position toward the second position, the second moving part is moved in a second direction opposed of the first direction, wherein movement of the second moving part in the second direction is not operative to cause the first moving part to disengage the panel.

16. A deal drawer apparatus comprising:

a housing including an upper opening and a front opening;

a drawer movably mounted in supporting connection with the housing, the drawer having an interior area and wherein the drawer is movable between a first position wherein the interior area is aligned with the upper opening, and a second position wherein the drawer is moved outward through the front opening;

a panel movably mounted in supporting connection with the housing, wherein the panel is movable between a non-access position wherein the panel blocks access through the upper opening and an access position wherein the panel enables access through the upper opening;

a drawer interlock, wherein the drawer interlock prevents the drawer from moving from the first position unless the panel is in the non-access position, wherein the drawer interlock further comprises a detent operative to releasibly hold the drawer in the first position when the panel is in the non-access position.

17. A deal drawer apparatus comprising:

a housing including an upper opening and a front opening;

a drawer movably mounted in supporting connection with the housing, the drawer having an interior area and wherein the drawer is movable between a first position wherein the interior area is aligned with the upper opening, and a second position wherein the drawer is moved outward through the front opening;

a panel movably mounted in supporting connection with the housing, wherein the panel is movable between a non-access position wherein the panel blocks access through the upper opening and an access position wherein the panel enables access through the upper opening;

a drawer interlock, wherein the housing comprises a housing portion, and wherein the panel comprises at least two overlying panel members, wherein in the access position the overlying panel members move beneath the housing portion.

18. A deal drawer apparatus comprising:

a housing, wherein the housing includes an upper opening and a front opening, a drawer, wherein the drawer is movably mounted in supporting connection with the housing, wherein the drawer has an interior area, wherein the drawer is movable between a first position and a second position, wherein in the first position the interior area is generally aligned with the upper opening, wherein in the second position the drawer is moved outward through the front opening, a panel, wherein the panel is movably mounted in supporting connection with the housing, wherein the panel is movable between a non-access position and an access position, wherein in the non-access position the panel blocks access through the upper opening, wherein in the access position the panel enables access through the upper opening, a drawer interlock, wherein the drawer interlock comprises a member, wherein the member is movable responsive to the position of the panel, wherein the drawer interlock prevents the drawer from moving to the second position unless the panel is in the non-access position.

19. The apparatus according to claim 18 wherein the member comprises a rotatably movable member, and wherein the rotatably movable member is rotatably moved responsive to the position of the panel.

20. The apparatus according to claim 19 and further comprising a movable member in operative connection with the drawer, wherein the movable member is operative to move and disengage from the rotatably movable member when the panel is in the non-access position, and wherein movement of the movable member is restricted when the panel is in the access position.

21. The apparatus according to claim 19, wherein the drawer is operative to move from the first position to the second position and from the second position to the first position when the panel is in a non-access position, and wherein the rotatably movable member is operative to prevent movement of the drawer from the first position when the panel is in the access position.

* * * * *